US008424720B2

(12) United States Patent
Tracy et al.

(10) Patent No.: US 8,424,720 B2
(45) Date of Patent: Apr. 23, 2013

(54) MAGNETIC DRIVE FOR DISPENSING APPARATUS

(75) Inventors: Robert W. Tracy, Haverhill, MA (US); Kenneth C. Crouch, North Andover, MA (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 13/423,767

(22) Filed: Mar. 19, 2012

(65) Prior Publication Data

US 2012/0175386 A1 Jul. 12, 2012

Related U.S. Application Data

(62) Division of application No. 12/421,327, filed on Apr. 9, 2009, now Pat. No. 8,136,705.

(51) Int. Cl.
*B05C 5/00* (2006.01)

(52) U.S. Cl.
USPC ..... 222/1; 222/333

(58) Field of Classification Search ..... 222/1, 63, 222/309–311, 333, 410, 411; 118/243, 263
See application file for complete search history.

(56) References Cited

U.S. PATENT DOCUMENTS

| | | | | |
|---|---|---|---|---|
| 4,422,151 | A | 12/1983 | Gilson | |
| 4,646,676 | A | 3/1987 | Kidder et al. | |
| 4,696,417 | A | 9/1987 | Ugolini | |
| 5,423,661 | A | 6/1995 | Gabeler et al. | |
| 5,819,983 | A | 10/1998 | White et al. | |
| 6,093,251 | A | 7/2000 | Carr et al. | |
| 6,775,879 | B2 | 8/2004 | Bibeault et al. | |
| 6,814,810 | B2 | 11/2004 | Prentice et al. | |
| 7,404,861 | B2 | 7/2008 | Prentice et al. | |
| 7,735,685 | B2 | 6/2010 | Bertram | |
| 7,861,896 | B2 | 1/2011 | Biesheuvel | |
| 7,980,197 | B2 | 7/2011 | Prentice et al. | |
| 2003/0084844 | A1 | 5/2003 | Yamauchi et al. | |
| 2003/0180152 | A1 * | 9/2003 | Payne | 417/53 |
| 2007/0080595 | A1 * | 4/2007 | Akiyama et al. | 310/104 |
| 2008/0105703 | A1 | 5/2008 | Prentice et al. | |
| 2009/0090431 | A1 * | 4/2009 | Yacko et al. | 141/26 |

OTHER PUBLICATIONS

International Search Report for PCT/US2010/026933 mailed May 11, 2010.

* cited by examiner

*Primary Examiner* — J. Casimer Jacyna
(74) *Attorney, Agent, or Firm* — Lando & Anastasi, LLP

(57) ABSTRACT

A dispenser for dispensing a volume of viscous material on a substrate includes a frame, a gantry system coupled to the frame, and a dispenser unit coupled to the gantry system. The dispenser unit includes a housing having a chamber, and a piston disposed in the chamber. The piston has an elongate body and is configured to move between a pre-dispense position and a dispense position within the chamber. The dispenser unit further includes a motor to drive the movement of the piston within the chamber. The motor includes a rotating shaft, a wheel coupled to the rotating shaft, the wheel having at least one drive magnet, and a driven magnet disposed between wheel and the piston. The dispenser further includes a nozzle coupled to the housing. The nozzle has an orifice to dispense viscous material. Other embodiments of the dispenser and methods of dispensing are further disclosed.

7 Claims, 19 Drawing Sheets

MAGNETIC DRIVE FOR DISPENSING APPARATUS

RELATED APPLICATIONS

This application is a divisional of pending U.S. patent application Ser. No. 12/421,327, filed Apr. 9, 2009, entitled MAGNETIC DRIVE FOR DISPENSING APPARATUS, which is incorporated herein by reference in its entirety.

BACKGROUND OF THE INVENTION

1. Field of the Invention

The disclosure relates generally to methods and apparatus for dispensing a viscous material on a substrate, such as a printed circuit board.

2. Discussion of Related Art

There are several types of prior art dispensing systems used for dispensing metered amounts of liquid or paste for a variety of applications. One such application is the assembly of integrated circuit chips and other electronic components onto circuit board substrates. In this application, automated dispensing systems are used for dispensing dots of liquid epoxy or solder paste, or some other related material, onto circuit boards. Automated dispensing systems are also used for dispensing lines of underfill materials and encapsulents, which mechanically secure components to the circuit board. Underfill materials and encapsulents are used to improve the mechanical and environmental characteristics of the assembly.

Another application is to dispense very small amounts or dots onto a circuit board. In one system capable of dispensing dots of material, a dispenser unit utilizes a rotating auger having a helical groove to force material out of a nozzle and onto a circuit board. One such system is disclosed in U.S. Pat. No. 5,819,983, entitled LIQUID DISPENSING SYSTEM WITH SEALING AUGERING SCREW AND METHOD FOR DISPENSING, which is owned by Speedline Technologies, Inc. of Franklin, Mass., the assignee of the disclosure.

In an operation employing an auger-type dispenser, the dispenser unit is lowered towards the surface of the circuit board prior to dispensing a dot or a line of material onto the circuit board and raised after dispensing the dot or line of material. Using this type of dispenser, small, precise quantities of material may be placed with great accuracy. The time required to lower and raise the dispenser unit in a direction normal to the circuit board, typically known as a z-axis movement, can contribute to the time required to perform dispensing operations. Specifically, with auger-type dispensers, prior to dispensing the dot or line of material, the dispenser unit is lowered so that the material touches or "wets" the circuit board. The process of wetting contributes to additional time to perform the dispensing operation.

It is also known in the field of automated dispensers to stream viscous material on the circuit board. Such a system is shown and described in U.S. patent application Ser. No. 11/707,620, filed Feb. 16, 2007, entitled METHOD AND APPARATUS FOR DISPENSING A VISCOUS MATERIAL ON A SUBSTRATE, which claims priority to U.S. Provisional Patent Application No. 60/856,508, filed Nov. 3, 2006, both of which are owned by Speedline Technologies, Inc. of Franklin, Mass. and incorporated herein by reference for all purposes.

SUMMARY OF THE INVENTION

An aspect of the invention is directed to a dispenser for dispensing a volume of viscous material on a substrate. The dispenser comprises a frame, a gantry system coupled to the frame, and a dispenser unit coupled to the gantry system. The dispenser unit comprises a housing having a chamber and a piston disposed in the chamber. The piston is configured to move between a pre-dispense position and a dispense position within the chamber. A motor is coupled to the piston to drive the movement of the piston within the chamber. The dispenser unit further comprises a dispensing bore configured to receive the piston therein and a nozzle coupled to the housing. The nozzle has an orifice co-axial with the dispensing bore. A controller is coupled to the motor to control the operation of the motor. The dispenser is constructed such that a volume of viscous material dispensed from the dispensing bore is substantially equal to the volume of the piston entering the dispensing bore when moving the piston to the dispense position.

Embodiments of the dispenser may include the following features. The housing may include a surface formed therein, and the motor may include a connector coupled to the piston. The connector includes a surface configured to engage the surface of the housing to limit the movement of the piston to the dispense position. The surface of the housing may include compliant material. The connector may be removably coupled to the piston. The housing may comprise a barrel disposed within the chamber. The barrel may have an inner diameter sized to slidably receive the piston therein. The dispensing bore may be integrally formed with the barrel. The barrel and the piston may be selected to change a diameter of the dispensing bore. The motor may comprise a linear voice coil motor. The orifice may have a small-diameter bore in fluid communication with the dispensing bore, the small-diameter bore being smaller in diameter than the dispensing bore. The dispenser unit further may comprise an opening formed in the housing to deliver viscous material to the dispensing bore. The housing may be configured such that the delivery of viscous material to the dispensing bore is blocked by the piston as the piston moves to the dispense position. The piston may have a flat end at an end adjacent the dispensing bore. In a certain embodiment, the nozzle may comprise a head portion and a needle portion extending from the head portion. The needle portion may have a needle bore that is co-axial with the dispensing bore. A retainer may be configured to capture the head portion of the nozzle to removably secure the nozzle to the housing.

Another aspect of the invention is directed to a dispenser for dispensing a viscous material on a substrate. The dispenser comprises a frame, a gantry system coupled to the frame, and a dispenser unit coupled to the gantry system. In one embodiment, the dispenser unit comprises a housing having a chamber, a barrel disposed within the chamber, and a piston disposed in the barrel. The piston is configured to move between a pre-dispense position and a dispense position within the chamber. The dispenser unit further comprises a dispensing bore configured to receive the piston therein when moving the piston to the dispense position and a nozzle coupled to the housing. The nozzle has an orifice co-axial with the dispensing bore. A motor is coupled to the piston to drive the movement of the piston within the barrel. A controller is coupled to the motor to control the operation of the motor.

A further embodiment of the invention is directed to a dispenser for dispensing a viscous material on a substrate. The dispenser comprises a frame, a gantry system coupled to the frame, and a dispenser unit coupled to the gantry system. The dispenser unit comprises a housing having a chamber, an opening formed in the housing to deliver viscous material to the chamber, and a piston disposed in the chamber. The piston is configured to move from a charge position to a dispense position within the chamber. A motor is coupled to the piston to drive the movement of the piston between the retracted position and the extended position within the chamber. A dispensing bore is configured to receive the piston therein when moving the piston to the dispense position. A nozzle is coupled to the housing, the nozzle having an orifice co-axial with the dispensing bore. A controller is coupled to the motor to control the operation of the motor. The dispenser is constructed such that the piston is configured to move from the charge position in which viscous material may be delivered to the chamber via the opening to the dispense position in which the piston is moved toward the dispensing bore of the nozzle to block the delivery of viscous material into the dispensing bore.

Yet another aspect of the invention is directed to a method of dispensing viscous material from a dispenser of the type having a chamber, an opening to deliver viscous material to the chamber, a dispensing bore in fluid communication with the chamber, and a piston movable within the dispensing bore. The method comprises: moving the piston in a direction away from the dispensing bore; delivering viscous material to the chamber through the opening; moving the piston in a direction toward the dispensing bore; cutting off the delivery of viscous material by blocking the opening with the piston as the piston moves toward the dispensing bore; and ejecting a quantity of viscous material.

A further aspect of the invention is directed to a method of dispensing viscous material from a dispenser of the type having a chamber, a dispensing bore in fluid communication with the chamber, and a piston movable within the dispensing bore. The method comprises: moving the piston in a direction away from the dispensing bore; delivering viscous material to the chamber through the opening; moving the piston in a direction toward the dispensing bore; and ejecting a quantity of viscous material substantially equal to the volume of the piston moved into the dispensing bore.

An additional aspect of the invention is directed to a method of dispensing viscous material from a dispenser of the type having a chamber, a barrel having an elongated bore formed therein, the barrel being disposed in the chamber, a dispensing bore in fluid communication with the chamber and the elongated bore of the barrel, and a piston disposed within the elongated bore of the barrel and configured to enter the dispensing bore to dispense a quantity of viscous material. The method comprising: selecting a barrel to be disposed within the chamber; selecting a piston to be disposed within the elongated bore of the barrel; installing the barrel and the piston within the chamber; moving the piston in a direction away from the dispensing bore; delivering viscous material to the dispensing bore; moving the piston in a direction toward the dispensing bore; and ejecting a quantity of viscous material.

Yet another aspect of the invention is directed to a dispenser for dispensing a volume of viscous material on a substrate comprising a frame, a gantry system coupled to the frame and a dispenser unit coupled to the gantry system. The dispenser unit comprises a housing having a chamber and a piston disposed in the chamber. The piston is configured to move between a pre-dispense position and a dispense position within the chamber. A motor is coupled to the piston to drive the movement of the piston within the chamber. A dispensing bore is configured to receive the piston therein. A nozzle is coupled to the housing to dispense material on the substrate. The nozzle includes a head portion and a needle portion extending from the head portion. The needle portion includes a needle bore having an inner diameter and a length substantially greater than the inner diameter. The needle bore is co-axial with the dispensing bore. A retainer is configured to capture the head portion of the nozzle to removably secure the nozzle to the housing. A controller is coupled to the motor to control the operation of the motor to perform a dispense operation of viscous material on the substrate.

An aspect of the disclosure is further directed to a dispenser for dispensing a volume of viscous material on a substrate. In a certain embodiment, the dispenser comprises a frame, a gantry system coupled to the frame, and a dispenser unit coupled to the gantry system. The dispenser unit comprises a housing having a chamber, and a piston disposed in the chamber. The piston has an elongate body and is configured to move between a pre-dispense position and a dispense position within the chamber. The dispenser unit further comprises a motor to drive the movement of the piston within the chamber. In one embodiment, the motor comprises a rotating shaft, a wheel coupled to the rotating shaft, the wheel having at least one drive magnet, and a driven magnet disposed between wheel and the piston. The dispenser further comprises a nozzle coupled to the housing. The nozzle has an orifice to dispense viscous material.

Embodiments of the dispenser may further include a controller coupled to the motor to control the operation of the motor. In one embodiment, the motor comprises a plurality of drive magnets disposed circumferentially around the wheel. The drive magnets may be equally spaced from one another. The motor may further comprise a magnet guide having a bore configured to receive the driven magnet. The piston further has a head located at a top of the piston, the head being attached to the driven magnet.

Another aspect of the disclosure is directed to a method of driving reciprocating movement of a piston within a dispensing bore of a dispenser unit configured to dispense viscous material. In a certain embodiment, the method comprises: disposing a head of the piston between at least one drive magnet and a driven magnet; rotating the at least one drive magnet with a drive motor to cause the movement of the piston; and ejecting a quantity of viscous material when moving the piston.

Yet another aspect of the disclosure is directed to a motor coupled to a piston to drive reciprocating movement of the piston within the chamber. In one embodiment, the motor comprises a rotating shaft, a wheel coupled to the rotating shaft, the wheel having at least one drive magnet, and a driven magnet disposed between wheel and the head of the piston.

Embodiments of the motor may include a plurality of drive magnets disposed circumferentially around the wheel. The drive magnets may be equally spaced from one another. The motor may further comprise a magnet guide configured to receive the driven magnet. The drive magnets may be spaced from one another predetermined distances.

BRIEF DESCRIPTION OF THE DRAWINGS

For a better understanding of the disclosure, reference is made to the figures which are incorporated herein by reference and in which.

DETAILED DESCRIPTION OF THE PREFERRED EMBODIMENTS

Figure 1:
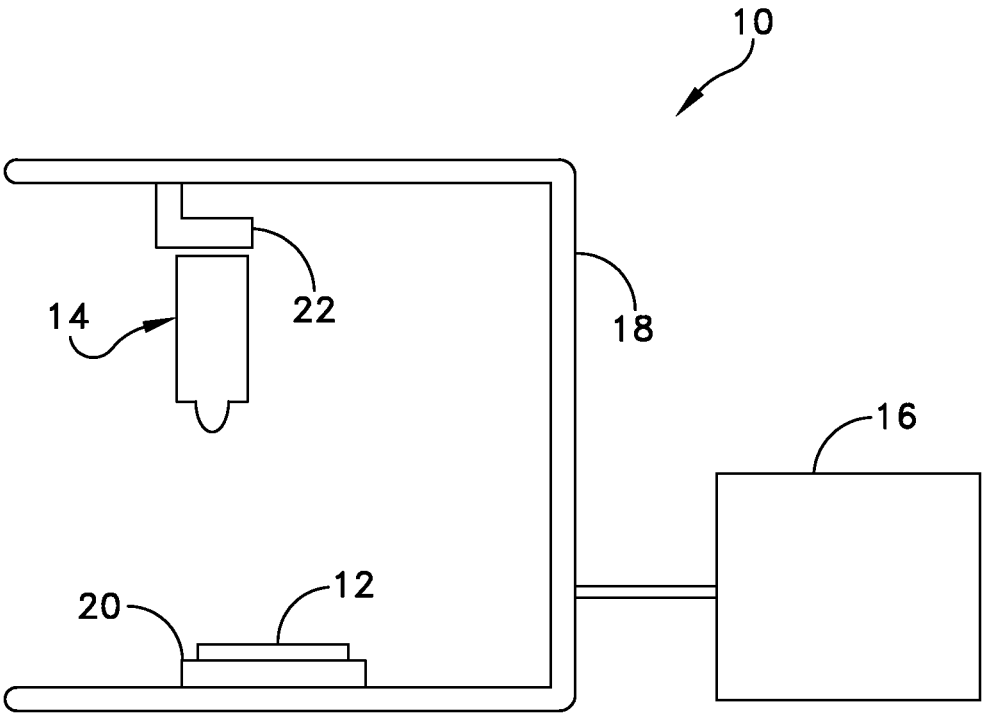
FIG. 1 is a schematic view of a dispenser used with embodiments of the disclosure.

For the purposes of illustration only, and not to limit the generality, the disclosure will now be described in detail with reference to the accompanying figures. This disclosure is not limited in its application to the details of construction and the arrangement of components set forth in the following description or illustrated in the drawings. The disclosure is capable of other embodiments and of being practiced or being carried out in various ways. Also the phraseology and terminology used herein is for the purpose of description and should not be regarded as limiting. The use of "including," "comprising," "having," "containing," "involving," and variations thereof herein, is meant to encompass the items listed thereafter and equivalents thereof as well as additional items.

Embodiments of the disclosure are directed to dispenser units, methods of dispensing and dispensing systems that contain methods and apparatus of the disclosure. Embodiments of the disclosure can be used with dispensing systems offered under the brand name CAMALOT® by Speedline Technologies, Inc. of Franklin, Mass., the assignee of the disclosure.

FIG. 1 illustrates a dispenser in accordance with one embodiment of the disclosure, generally indicated at 10, used to dispense a viscous material (e.g., adhesive, encapsulent, epoxy, solder paste, underfill material, etc.) or a semi-viscous material (e.g., soldering flux, etc.) onto a printed circuit board 12. The dispenser 10 includes a dispenser unit or head generally indicated at 14 and a controller 16. The dispenser unit may sometimes be referred to herein as a micro-piston pump unit. The dispenser 10 also includes a frame 18 having a base 20 for supporting the circuit board 12 and an arm 22 for supporting the dispenser unit 14. As is well known in the art of printed circuit board fabrication, a conveyor system (not shown) may be used in the dispenser 10 to control loading and unloading of circuit boards to and from the dispenser. The arm 22 is movably coupled to the frame 18. The arm 22 can be moved using motors under the control of the controller 16 in the x-axis, y-axis and z-axis directions to position the dispenser unit at predetermined locations, and heights, if necessary, over the circuit board 12.

In one embodiment, as discussed below, the dispenser 10 is constructed to provide needleless dispensing with a controlled volumetric flow rate for each deposit. In addition, in at least one embodiment, the dispenser unit 14 may be moved laterally across the circuit board 12, or other substrate, during dispensing. Further, in embodiments, the dispenser 10 is controlled to provide sufficient velocity to material being dispensed.

Figure 2:
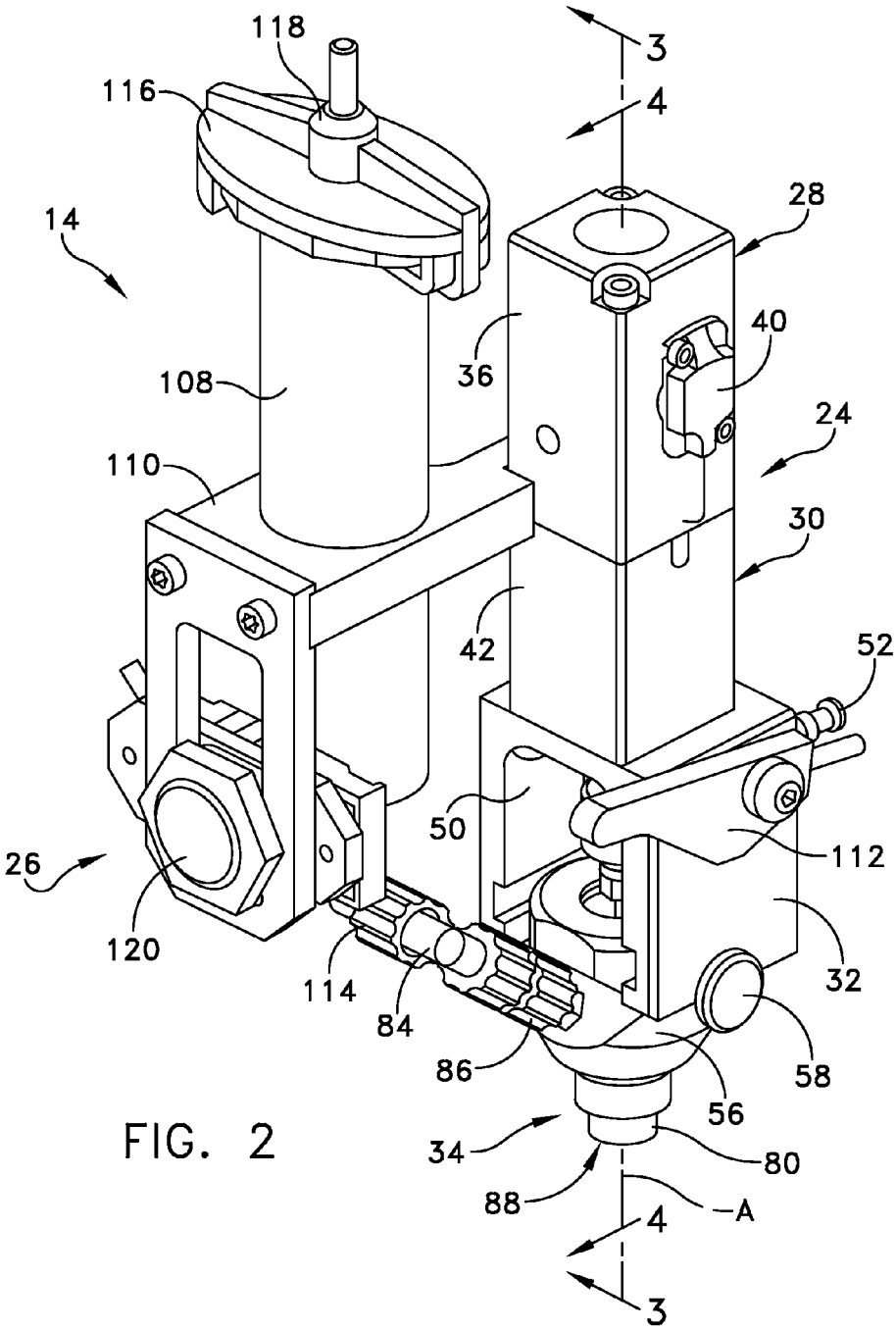
FIG. 2 is a perspective view of a dispenser unit of an embodiment of the disclosure.
Figure 3:
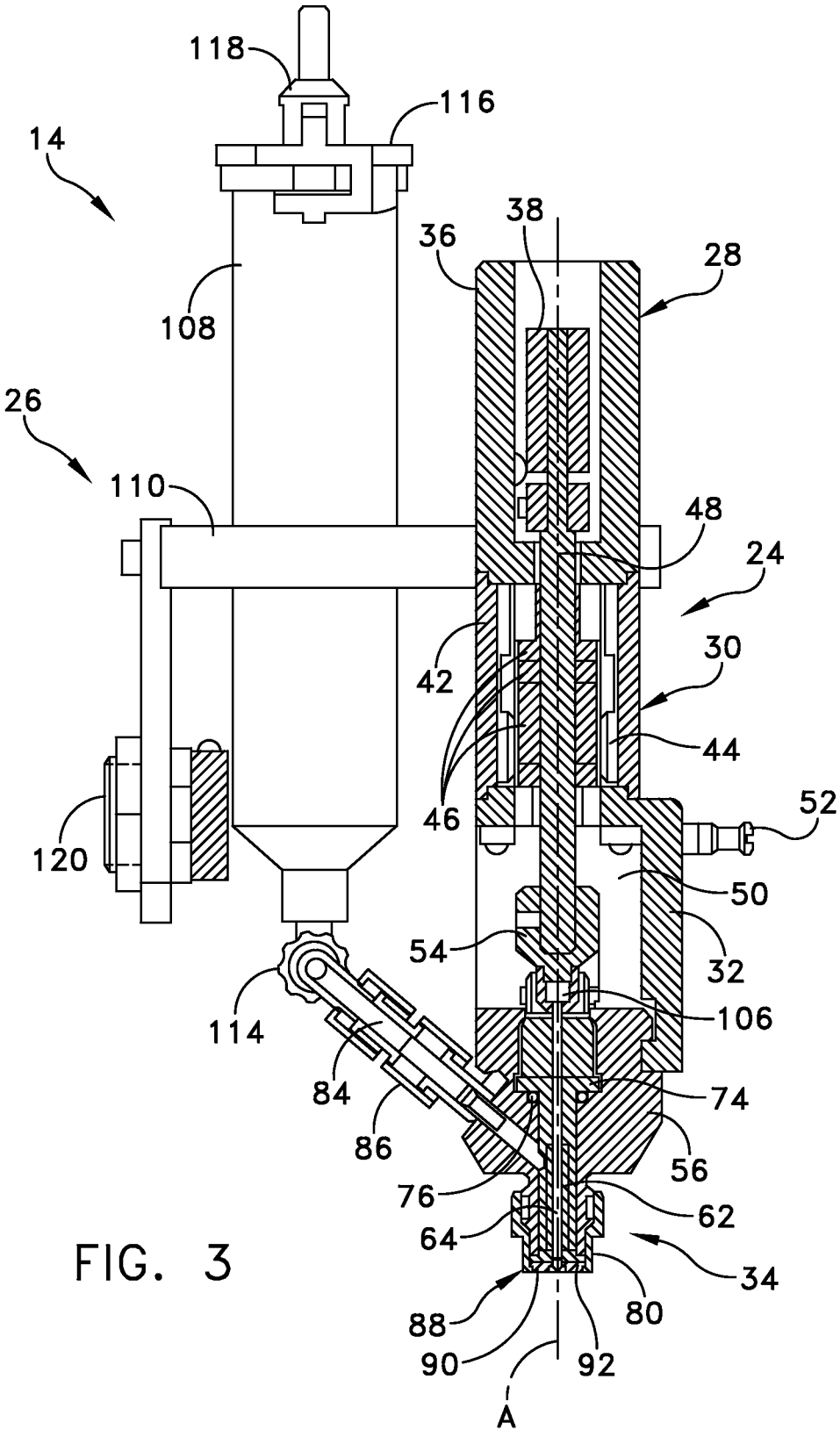
FIG. 3 is a cross-sectional view taken along line 3-3 of the dispenser unit shown in FIG. 2.
Figure 4:
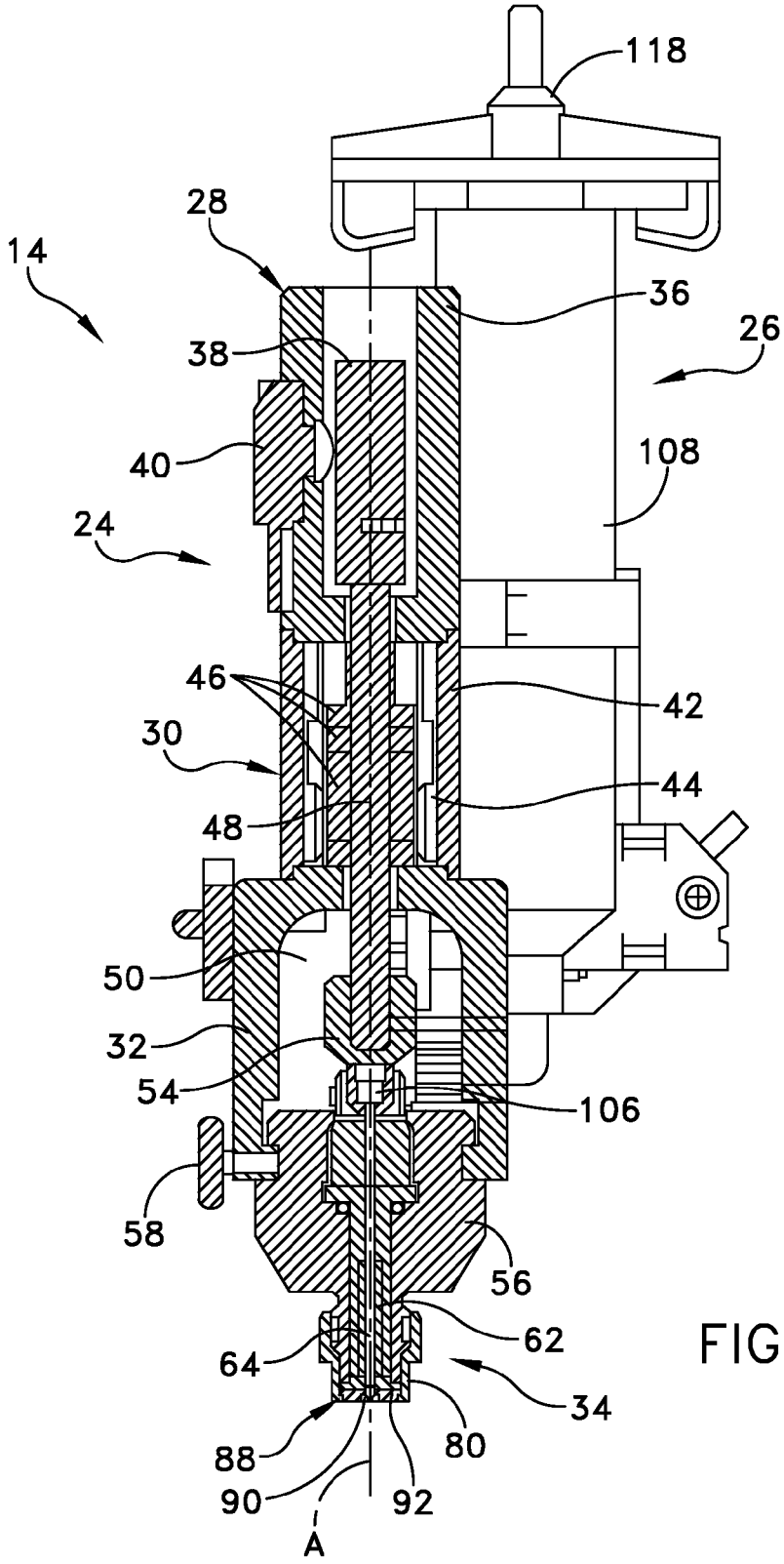
FIG. 4 is a cross-sectional view taken along line 4-4 of the dispenser unit shown in FIG. 2.

Referring now to FIG. 2, the dispenser unit 14 includes a dispensing assembly, generally indicated at 24, and a material supply assembly, generally indicated at 26, which is secured to the dispensing assembly and configured to supply viscous material to the dispensing assembly. Examples of viscous materials include, and are not limited to, solder pastes, fluxes, encapsulants, adhesives, underfills, and any other material used to mount electronic components on a printed circuit board or similar substrate. The material supply assembly 26 is designed to contain the viscous material under pressure and deliver the pressurized viscous material to the dispensing assembly 24. The dispensing assembly 24 is designed to move over the substrate (e.g., printed circuit board 12) in x- and y-directions via the arm 22 under the control of the controller 16 and to eject dots of viscous material on the substrate.

Turning now generally to FIGS. 2-8, in one embodiment, the dispensing assembly 24 may be configured to include an encoder assembly generally indicated at 28, a motor assembly generally indicated at 30, a dispenser housing 32 and a nozzle assembly generally indicated at 34. Specifically, the encoder assembly 28 includes an encoder housing 36, an encoder scale 38 and a position encoder 40. The position encoder 40 of the encoder assembly 28 communicates with the controller 16 to provided closed-loop feedback on the position of the motor assembly 30 during the operation of the dispenser 10. The provision of an encoder with a moving scale 38 reduces inertia and eliminates the need for a flexing wire typically required by a moving encoder head and stationary scale.

In one embodiment, the motor assembly 30 is a voice coil motor that is configured to communicate with the controller 16. The motor assembly 30 may comprise a motor housing 42 fabricated from a ferromagnetic material, a voice coil 44, magnets 46, and a drive shaft 48 coupled with the magnets. As shown, the encoder housing 36 and the motor housing 42 are coupled together along axis A. The provision of a moving magnet voice coil motor eliminates flexing wires of traditional voice coil motors and provides enhanced thermal connection between the voice coil 44 and the motor housing 42 to enhance heat dissipation of the motor assembly 30.

The arrangement is such that the voice coil 44 is disposed between the magnets 46 and the ferromagnetic motor housing 42 to drive the up-and-down motion of the drive shaft 48 within the dispenser assembly 26. The position encoder 40 is located to sense the position of the drive shaft 48 as the drive shaft moves up and down within the motor housing 42. The controller 16 may be configured with a driver (not shown) that communicates with the motor assembly 30 and the encoder assembly 28. This arrangement precludes commutation and minimizes magnetic cogging to yield better control of the motor.

The dispenser housing 32, which is coupled to the motor housing 42 along axis A, is configured to define a chamber 50 (see FIGS. 3-8) through which a lower end of the drive shaft 48 moves. Connected to the lower end of the drive shaft 48 is a piston drive yoke or connector 54, which projects into the chamber 50 of the dispenser housing 32. As best shown in FIG. 8, a slot (not shown) is formed in the piston drive yoke 54 to receive an alignment pin 55, which assures alignment of the drive yoke and a piston adapter. The alignment pin 55 also provides a means of assuring correct alignment of the optical position encoder scale 38, which controls the position of the piston. A more detailed explanation of the piston drive yoke 54 will be provided below as the description of the dispenser unit 14 proceeds.

In a certain embodiment, the nozzle assembly 34 may include a nozzle housing 56, which is secured to the dispenser housing 32 with a retaining screw 58. The nozzle housing 56 may be configured to include a cylindrical chamber 60 configured to receive a barrel cylinder 62 and a piston 64 having an upper end and a lower end having a flat surface 70. The piston 64 is configured to be received and slidably moved within an elongated bore 72 formed in the barrel cylinder 62 along axis A. In one embodiment, the piston 64 has a diameter between 0.020 inches to 0.062 inches, with a preferred diameter of 0.032 inches. The elongated bore 72 of the barrel cylinder 62 is sized to receive the piston 64 therein so that the piston can slide within the bore.

A seal nut 74 and suitable seals 76, 78 (FIG. 5) secure an upper portion of the barrel cylinder 62 to the nozzle housing 56 within the cylindrical chamber 60. A piece of compliant material 79 may be disposed above the seal nut 74 to provide a resilient force to cause the rapid deceleration of the piston 64 as it completes its downward stroke. This configuration enables the dispenser 10 to operate relatively quietly. A lower portion of the barrel cylinder 62 is secured by a needle nut or retainer 80 of the nozzle assembly 34, which will be described in greater detail below. The cylindrical chamber 60 defines a small dispensing cavity that is in fluid communication with a material feed tube 84, which is adapted to receive material from the material supply assembly 26. As shown, the material feed tube 84 is releasably secured to the nozzle housing 56 by an inlet fitting 86. As will be described in greater detail below, the viscous material is delivered to the cylindrical chamber 60 to the small dispensing cavity under pressure.

Figure 7:
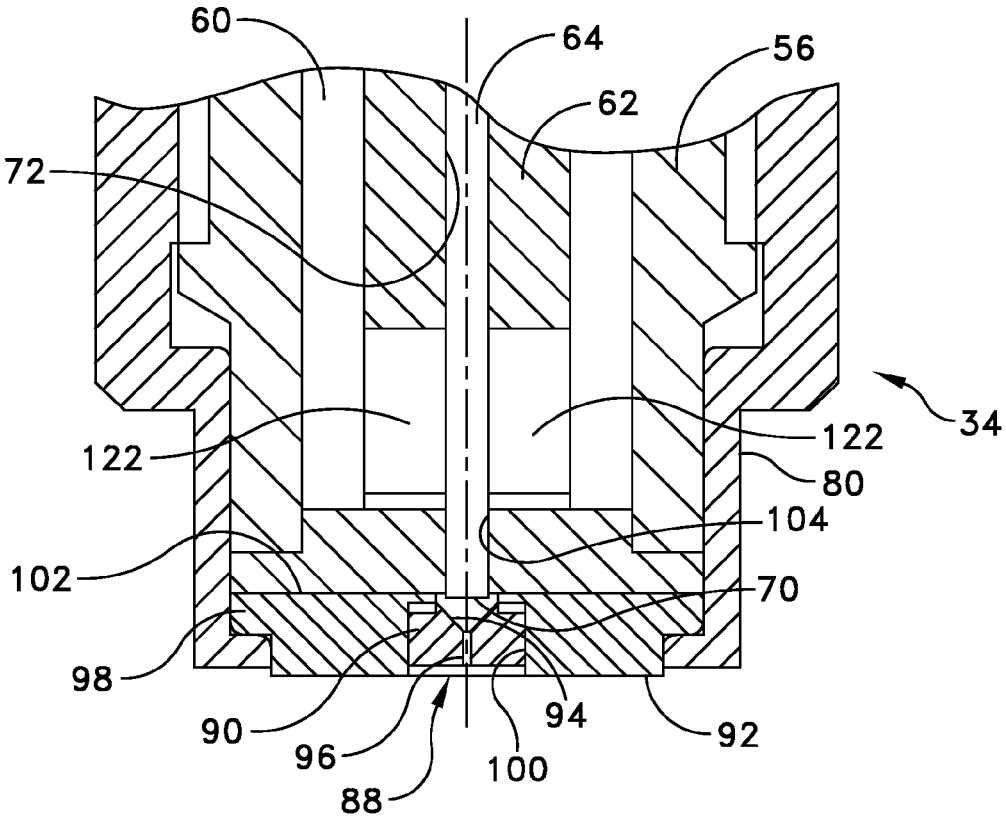
FIG. 7 is an enlarged cross-sectional view of an orifice assembly of the nozzle shown in FIG. 6.
Figure 8:
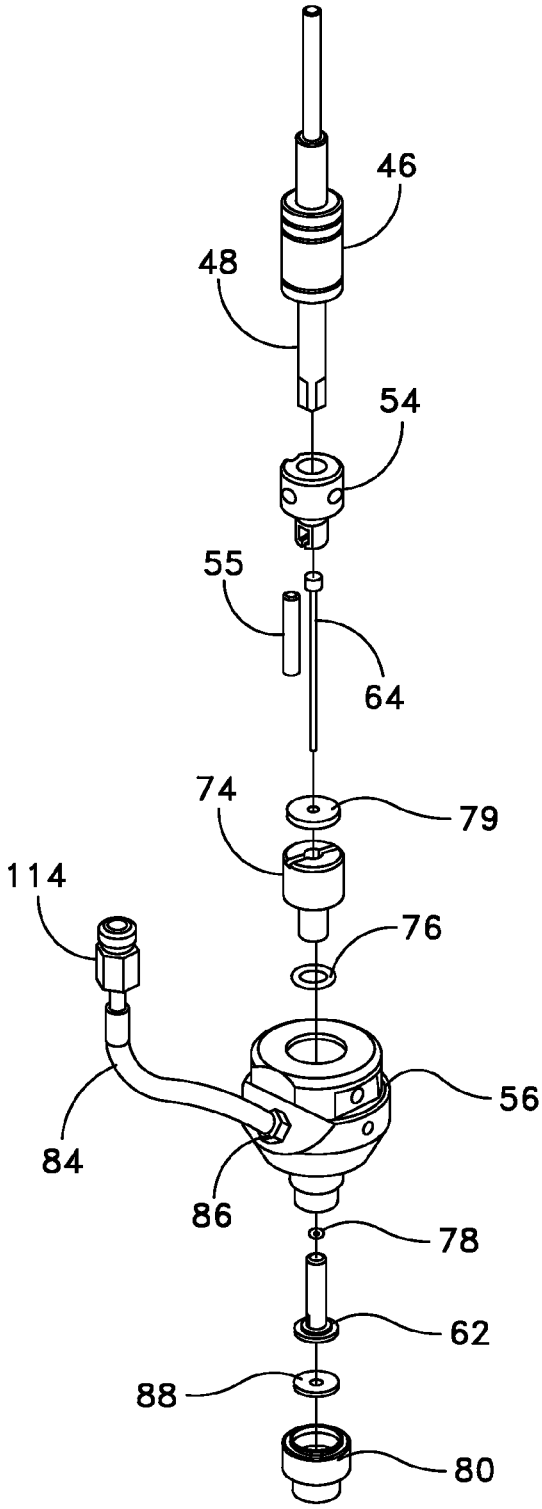
FIG. 8 is an exploded perspective view of internal components of the dispenser unit shown herein.

As best shown in FIG. 7, the nozzle assembly 34 further includes an orifice assembly, generally indicated at 88, designed to be threadably secured to the lower end of the nozzle housing 56 by the needle nut 80. Specifically, the orifice assembly 88 comprises an orifice insert 90, an orifice adapter 92 configured to receive the orifice insert, and the needle nut 80, which is configured to threadably attach the entire orifice assembly to the nozzle housing 56 by the needle nut 80. As shown, the orifice insert 90 is a generally cylindrical member having a conical surface 94 and a small-diameter bore 96, e.g., 0.005 inches in diameter, formed therein. In one embodiment, the orifice insert 90 may be fabricated from a hard material, such as synthetic sapphire.

The arrangement is such that viscous material is ejected from the small-diameter bore 96 onto a substrate, e.g., circuit board 12. The orifice adapter 92, in one embodiment, has a lower portion 98 with a recess 100 formed therein that is sized to receive the orifice insert 90. A swaged connection may be provided to secure the orifice insert 90 within the recess 100 of the lower portion 98 of the orifice adapter 92. The orifice adapter 92 communicates with a lower face 102 of the barrel cylinder 62. The barrel cylinder 62 further includes a dispensing bore 104 integrally formed therein that is in fluid communication with the cylindrical chamber 60. The dispensing bore 104 is sized to receive the lower portion of the piston 64 when performing a dispensing stroke as illustrated in FIG. 7. As shown, the small-diameter bore 96 is co-axial with the dispensing bore 104. There is no need to adjust the position of the small-diameter bore 96 since the orifice insert 90 is mechanically constrained by the orifice adapter 92 and the needle nut 80. In a particular embodiment, the nozzle assembly 34 may be provided as a complete assembly to the end user of the dispenser 10 to aid in cleaning of the nozzle assembly. Specifically, a used nozzle assembly may be completely removed from the dispenser unit 14 of the dispenser 10 by unscrewing the needle nut 80 and replaced with a new (clean) nozzle assembly.

Figure 5:
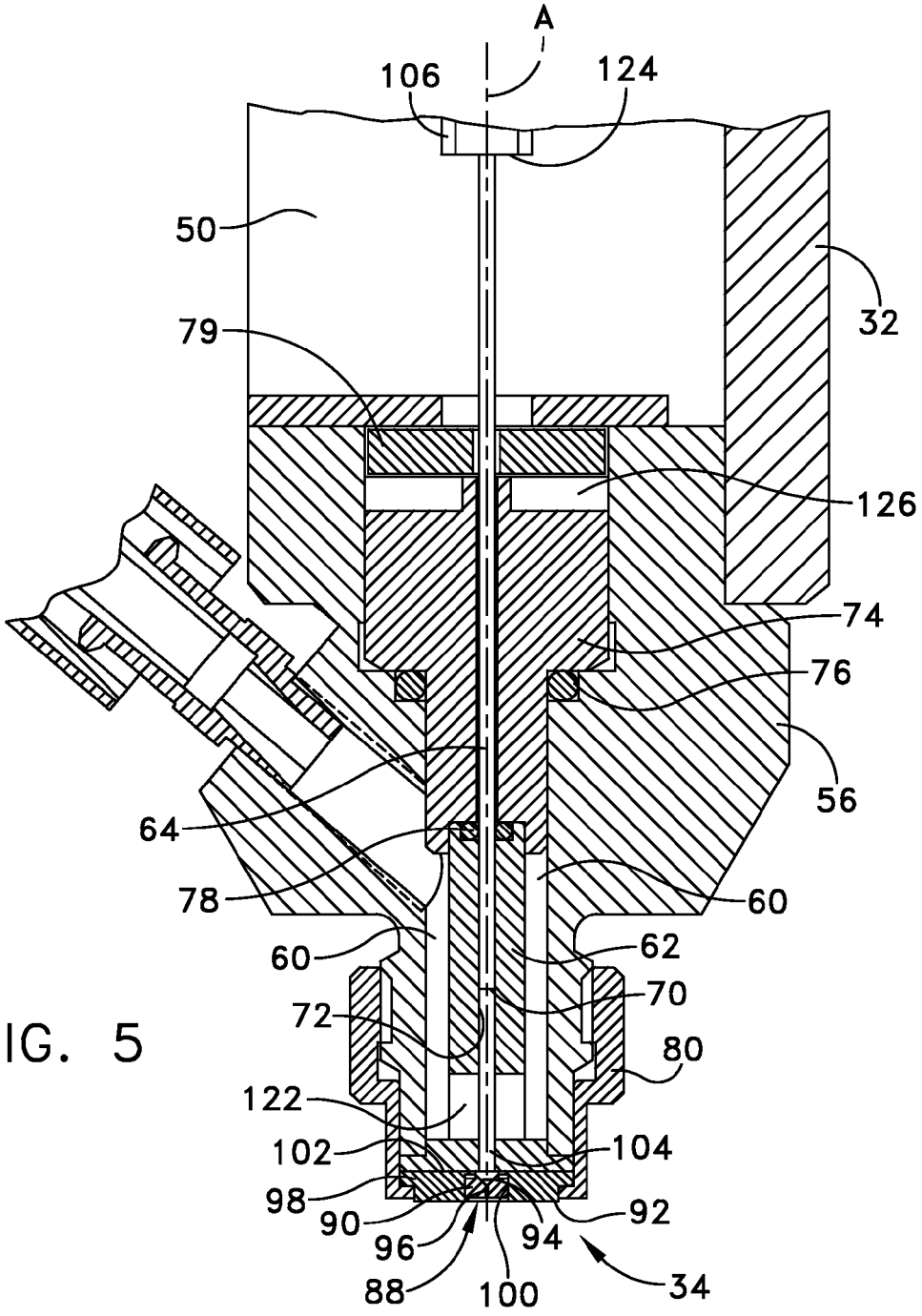
FIG. 5 is an enlarged cross-sectional view of a nozzle of the dispenser unit shown in FIG. 3 in a pre-dispense position.
Figure 6:
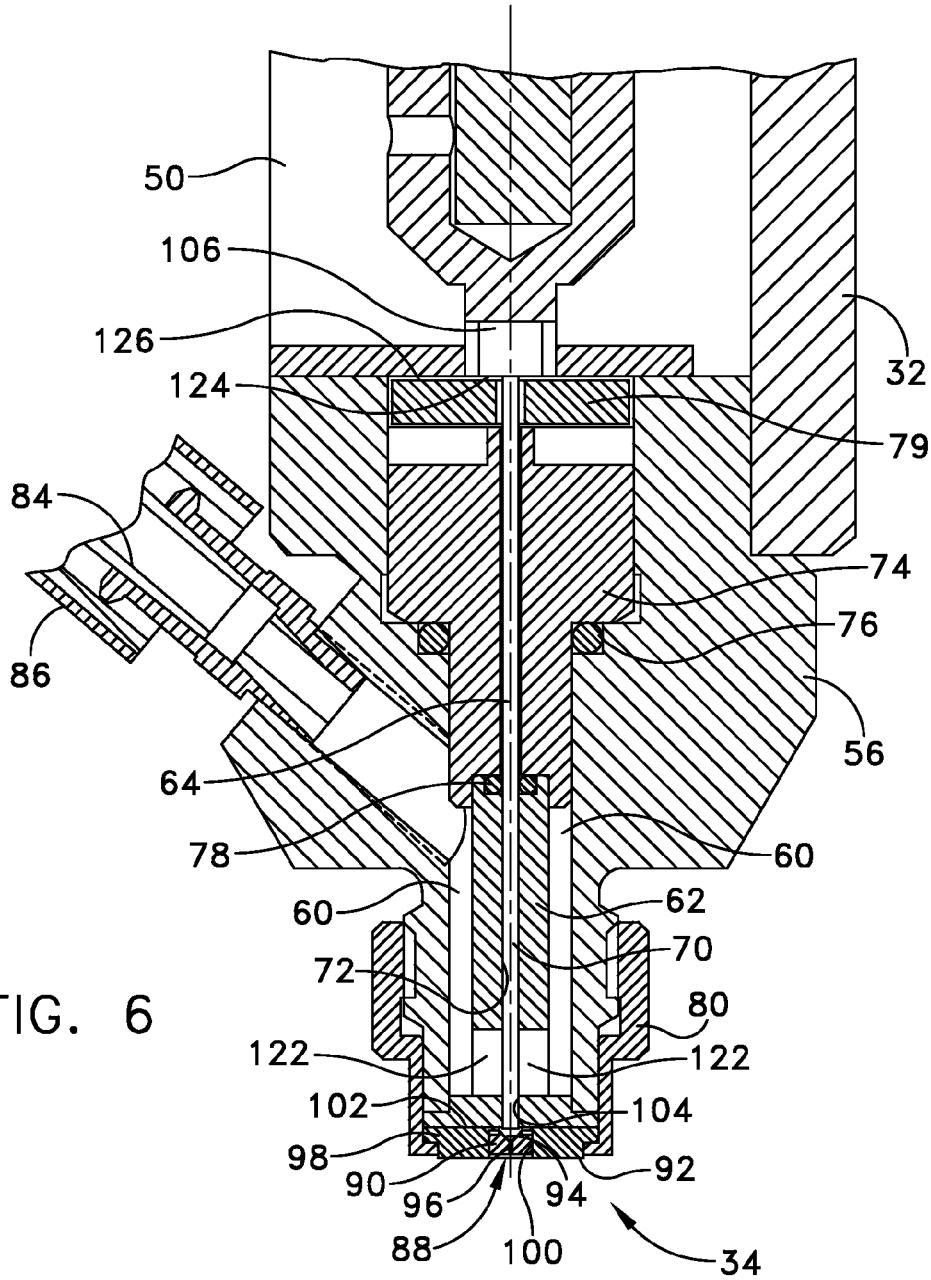
FIG. 6 is an enlarged cross-sectional view of the nozzle shown in a dispense position.

Referring back to FIGS. 3-6, and more particularly to FIGS. 3 and 4, in a certain embodiment, the upper portion of the piston 64 includes an enlarged head 106 that is captured by and secured to the piston drive yoke 54 of the motor assembly 30. Thus, the arrangement is such that the motor assembly 30 drives the up-and-down motion of the piston 64 within the chamber 50 by moving the drive shaft 48. The piston 64 is configured to reciprocally move between a retracted, pre-dispense position (FIG. 5) and an extended, dispense position (FIG. 6). The volume of viscous material dispensed by the dispenser unit 14 is substantially equal or at least related to the volume of the piston 64 entering the dispensing bore 104 (FIG. 7) as the piston travels toward the orifice insert 90. The flat end 70 of the piston 64 assists in shearing trapped fluid filler particles contained within the dispensing bore 104 when the lower portion of the piston is lowered therein, thereby closing off inlet passage 122.

In the shown embodiment, the material supply assembly 26 includes a material supply cartridge or container 108, the material feed tube 84, and a mounting assembly. As shown, the mounting assembly includes a mounting bracket 110 and a mounting lever 112. Mounting lever 112 operates a cam-lock to secure the dispenser unit 14 to the arm 22. The material feed tube 84 is connected to the cartridge 108 by an outlet fitting 114, which connects the cartridge to the nozzle housing 56 of the dispensing assembly 24 at an angle, which relies on gravity to enhance the flow of the viscous material into the chamber 50. A cap 116 is provided to close an upper end of the cartridge 108. The cap 116 is configured with an air pressure inlet 118, which supplies air under pressure to the cartridge to pressurize the viscous material contained within the cartridge. The pressurized viscous material flows from the cartridge 108 to the material feed tube 84 to the chamber 50 of the dispensing assembly 24. A material level sensor 120, which is coupled to the controller 16, may be provided to monitor the level of material contained within the cartridge 108.

Viscous material flows from the material feed tube 84 to the chamber 50 so that viscous material is deposited under pressure between an inner wall of the nozzle housing 56 that defines the cylindrical chamber 60 and an outer wall of the barrel cylinder 62. As best shown in FIGS. 5 and 6, viscous material enters the dispensing bore 104 by way of two narrow slits, each indicated at 122, formed in the barrel cylinder 62. The arrangement is such that when the piston 64 is in a retracted position, in which the motor assembly 30 raises the piston 64, viscous material enters the bore 72 formed in the barrel cylinder 62 and the dispensing bore 104. Thus, when the piston 64 is moved to an extended or dispensing position toward the orifice insert 90, in which the motor assembly 30 lowers the piston 64 via the drive shaft 48, the piston blocks the communication of viscous material between the narrow slits 122 and the dispensing bore 104 as material in the dispensing bore is dispensed. A sleeve (not shown) may be provided around the barrel cylinder 62 to selectively enlarge or reduce the size of the slits 122 to increase or decrease the amount of material entering the dispensing bore 104.

In the shown embodiment, the barrel cylinder 62, the piston 64 and the orifice insert 90 are removable and interchangeable so that the size of the dots of viscous material may be changed. For example, for larger dots, the size of the barrel cylinder 62, the piston 64, the small diameter bore 104, and dispensing bore 96 in the orifice insert 90 may be increased. Conversely, for smaller dots, these dimensions may be decreased. In addition, since the dispensing assembly 24 in general and the nozzle assembly 34 in particular are easily removable, these components, including the seals 76, 78, may be quickly and efficiently removed for cleaning and replacement.

When operating the dispenser 10, the piston 64 is moved between the retracted and extended positions to dispense dots of material from the dispensing bore 104 of the orifice adapter 92 via the small diameter bore 96 of the orifice insert 90. Specifically, and with reference to FIGS. 5 and 6, when the piston 64 is in its retracted position, viscous material enters the dispensing bore 104 from the cylindrical chamber 60 by way of slits 122. When moved to its extended position under the operation of the controller 16 via the drive shaft 48 of the motor assembly 30, the piston 64 cuts off the supply of viscous material to the dispensing bore 104 by blocking the slits 122 of the barrel cylinder 62. As discussed above, as the piston 64 enters the dispensing bore 104, the flat end 70 of the piston 64 shears trapped particles contained within the dispensing chamber within the dispensing bore 104. The arrangement is such that the volume of viscous material dispensed from the dispensing bore 104 is substantially equal to the volume of the piston entering the dispensing bore. The downward stroke of the piston 64 is limited by a shoulder portion or surface 124 of the head 106 of the piston that engages a shoulder portion or surface 126 defined by the compliant material 79 located above the seal nut 74. Thus, when dispensing a dot of material, the piston 64 enters into the dispensing bore 104 at a relatively fast rate of speed under the control of the controller 16 and the motor assembly 30 and immediately decelerates upon the engagement of the shoulder portions 124, 126 of the piston 64 and the seal nut 74 nozzle housing 56. The resilient material 79 cushions this immediate deceleration of the piston 64.

In one embodiment, to change the size of dots dispensed by the dispenser unit 14, the barrel cylinder 62, piston 64 and orifice insert 90 may be replaced. Specifically, by unscrewing the needle nut 80, the orifice insert 90 and the orifice adapter 92, which are contained within the needle nut, are also removed. Once removed, the barrel cylinder 62 may be removed from its seat within the seal nut 74. The barrel cylinder 62 may be replaced with another barrel cylinder having a bore 72 of a different diameter. The piston 64 is replaced by another piston having a diameter sized so that the piston slides within the bore 72 of the barrel cylinder 62. Additionally, the orifice insert 90 may be replaced to have a small diameter bore 96 and a dispensing bore 104 that are sized to work with the specific barrel cylinder 62 and piston 64. As mentioned above, the entire nozzle assembly 34 may be replaced with a replacement nozzle assembly to change the size of the small diameter bore of the orifice insert.

In another embodiment, the dispenser unit 14 may be configured with a heater to heat the viscous material as the material is ejected from the dispenser unit. Specifically, the heater is provided to reduce the viscosity of the material so as to better control the ejection of material from the dispenser unit. In one embodiment, the heater may be coupled to the nozzle housing 56, as by a clamping mechanism.

FIGS. 9A-9D illustrate the sequence of a dispense operation for a dispenser unit, generally indicated at 200, of an embodiment of the disclosure. As shown, the dispenser unit 200 is substantially identical to dispenser unit 14. Thus, corresponding parts are designated with corresponding reference numbers in FIGS. 9A-9D.

Figure 9A:
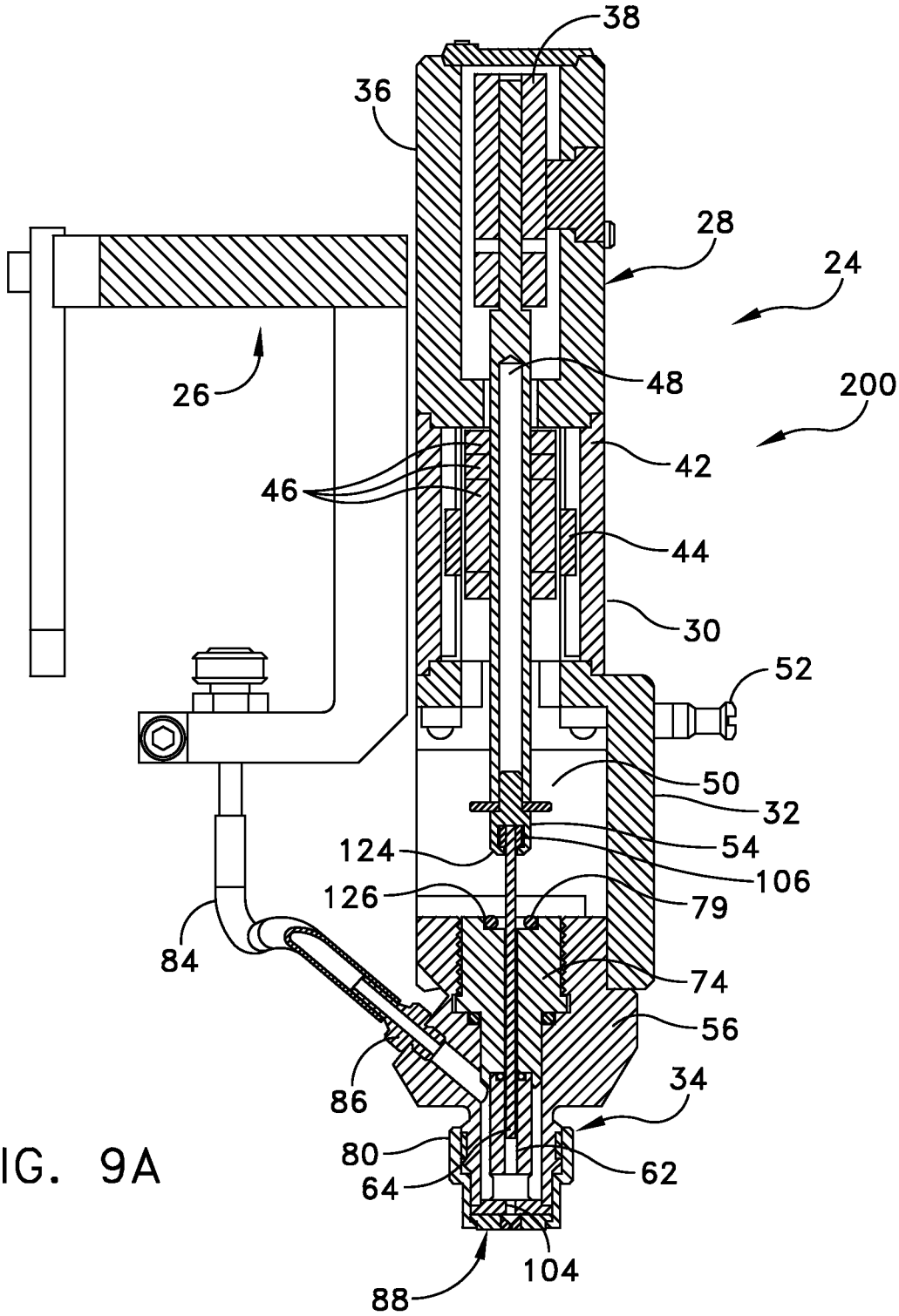
FIGS. 9A-9D are cross-sectional views of a dispenser unit of embodiments of the disclosure showing the dispenser unit in pre-dispense, park, dispense and charge positions, respectively.
Figure 9B:
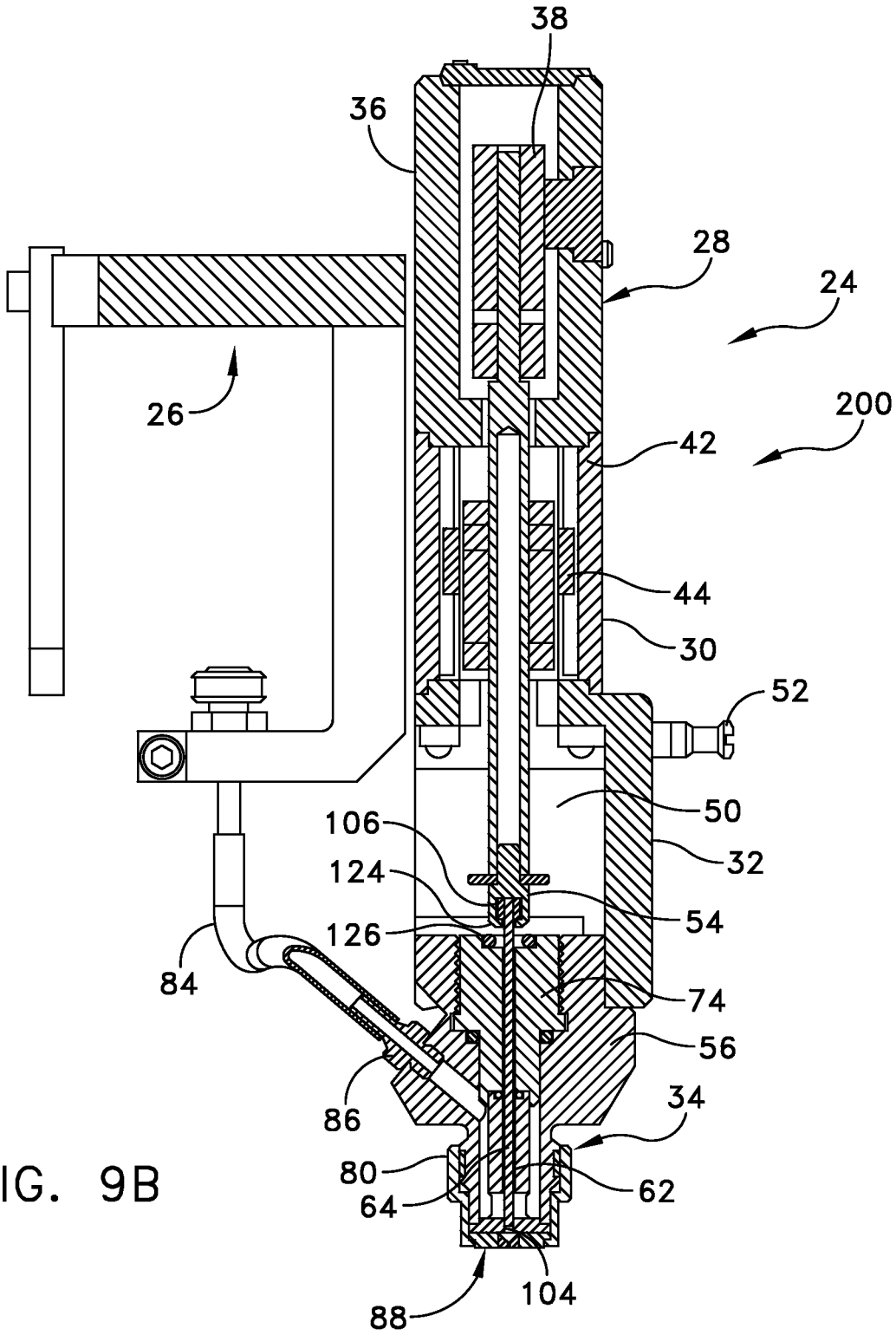
Figure 9C:
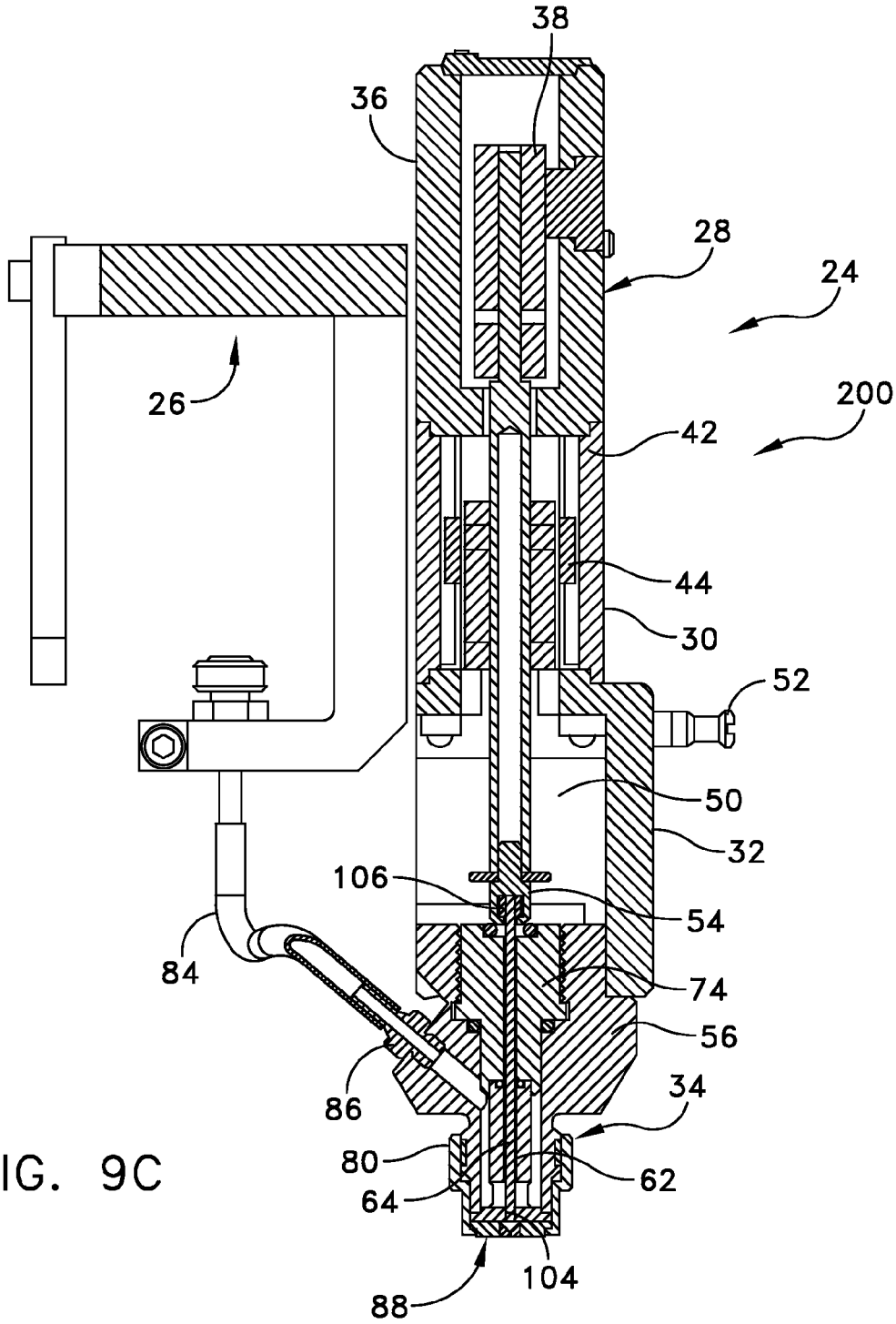

In FIG. 9A, the piston 64 is illustrated in a pre-dispense, retracted position. This position may be referred to as a "home" position. The motor assembly 30 drives the downward movement of the piston 64. FIG. 9B illustrates the piston 64 in a park position in which the piston is positioned within the dispensing bore 104 to block the delivery of viscous material into the dispensing bore. As shown, the piston 64 is positioned approximately two-thirds the way through the dispensing bore 104; however, the piston may be positioned at any location along the length of the dispensing bore. FIG. 9C illustrates the continued downward movement of the piston 64 to the aforementioned dispense position. Once in the dispense position, the volume of viscous material dispensed from the dispensing bore 104 is substantially equal to the volume of the piston entering the dispensing bore.

Figure 9D:
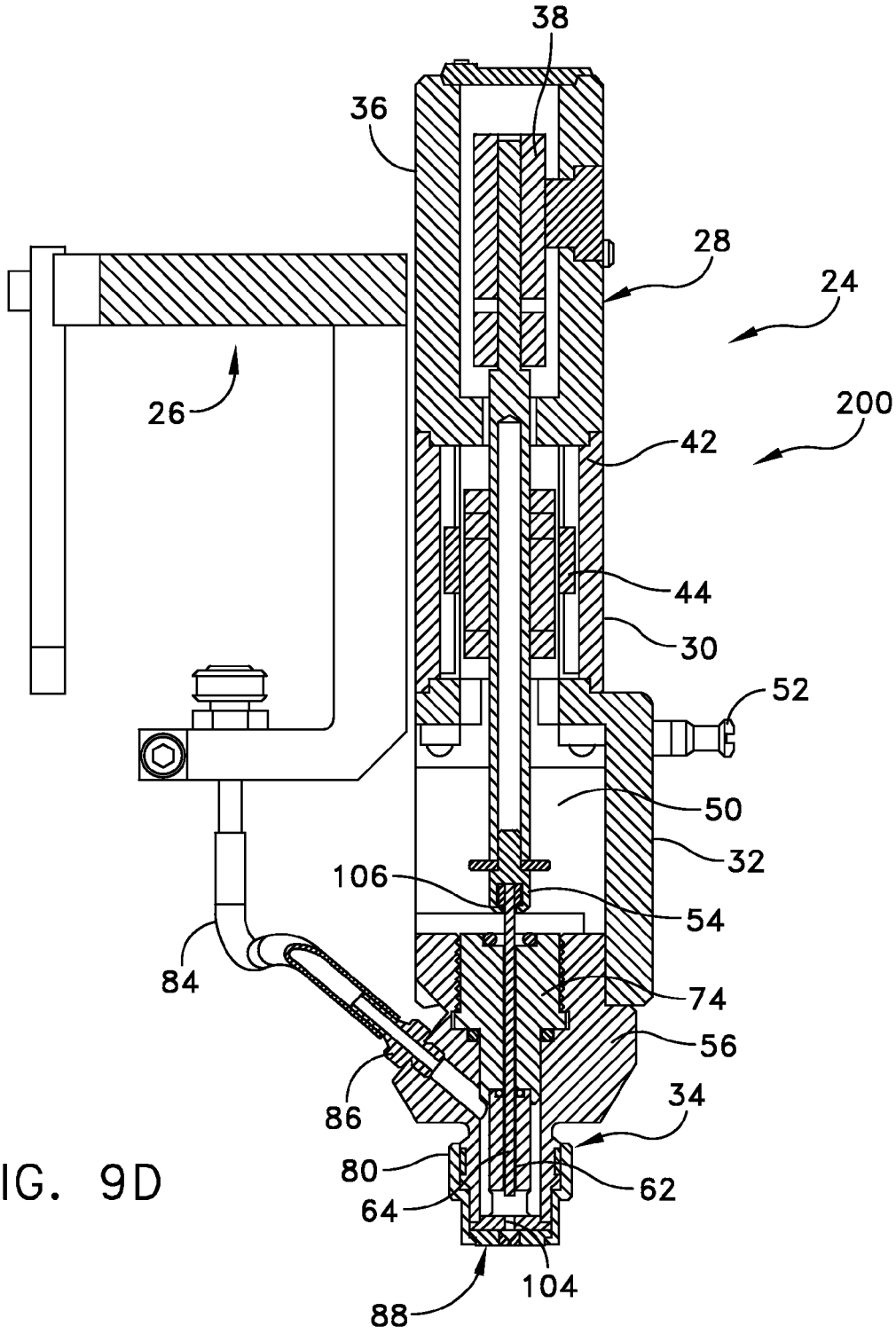

Next, as illustrated in FIG. 9D, the motor assembly 30 drives the upward movement of the piston 64 to a charge position in which the piston clears or at least partially clears the slits 122 to allow viscous material to enter the dispensing bore 104. It should be understood that the terms "charge position," "up position" and "pre-dispense" position are used herein interchangeably to describe the piston being in a raised or up position. Similarly, the use of "discharge position," "down position," "lowered position" and "post-dispense" position are used herein interchangeably to describe the piston being in a lowered or down position.

During operation, the piston 64 moves between the charge and dispense positions. When idle, the piston 64 may be moved to the park position to prevent material from being inadvertently dispensed. When not in use, the piston 64 may be moved via the motor assembly 30 back to the pre-dispense or home position illustrated in FIG. 9A.

Figure 9E:
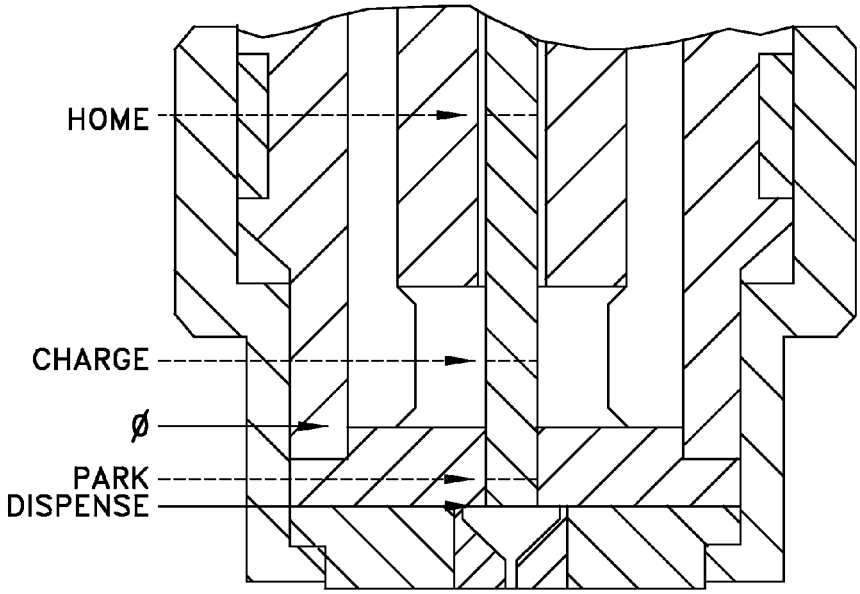
FIG. 9E is a cross-sectional view of a nozzle of the dispenser unit showing various positions of a piston of the dispenser unit.
Figure 9F:
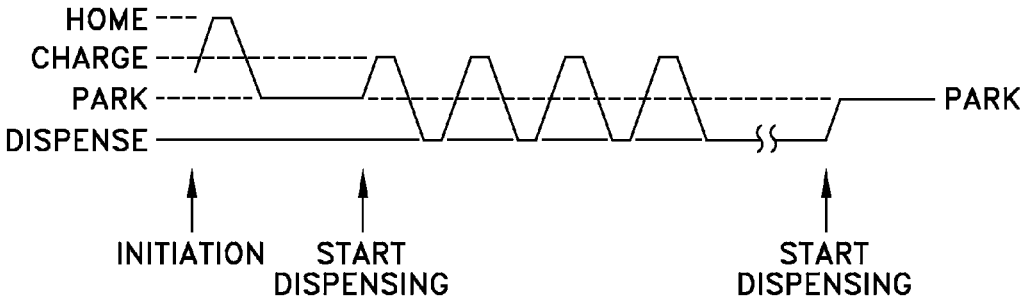
FIG. 9F is a diagram showing the position of the piston during an example operation of the dispenser unit.

In one embodiment, the movement of the piston is shown in FIG. 9F. As shown, the piston moves from a home position to a park position during an initiation process of the dispenser. During operation, the piston operates between the charge and dispense positions from the start of a particular dispense operation to the stop of the dispense operation. In the charge position, material flows into the dispensing bore from the chamber. The piston blocks the flow of material into the dispensing bore when the piston enters the dispensing bore. This is sometimes referred to as the "zero" position. The amount of material dispensed by the dispenser is substantially equal to volume of the piston that enters the dispensing bore. As shown in FIG. 9F, when stopped, the piston moves to the park position.

Figure 10:
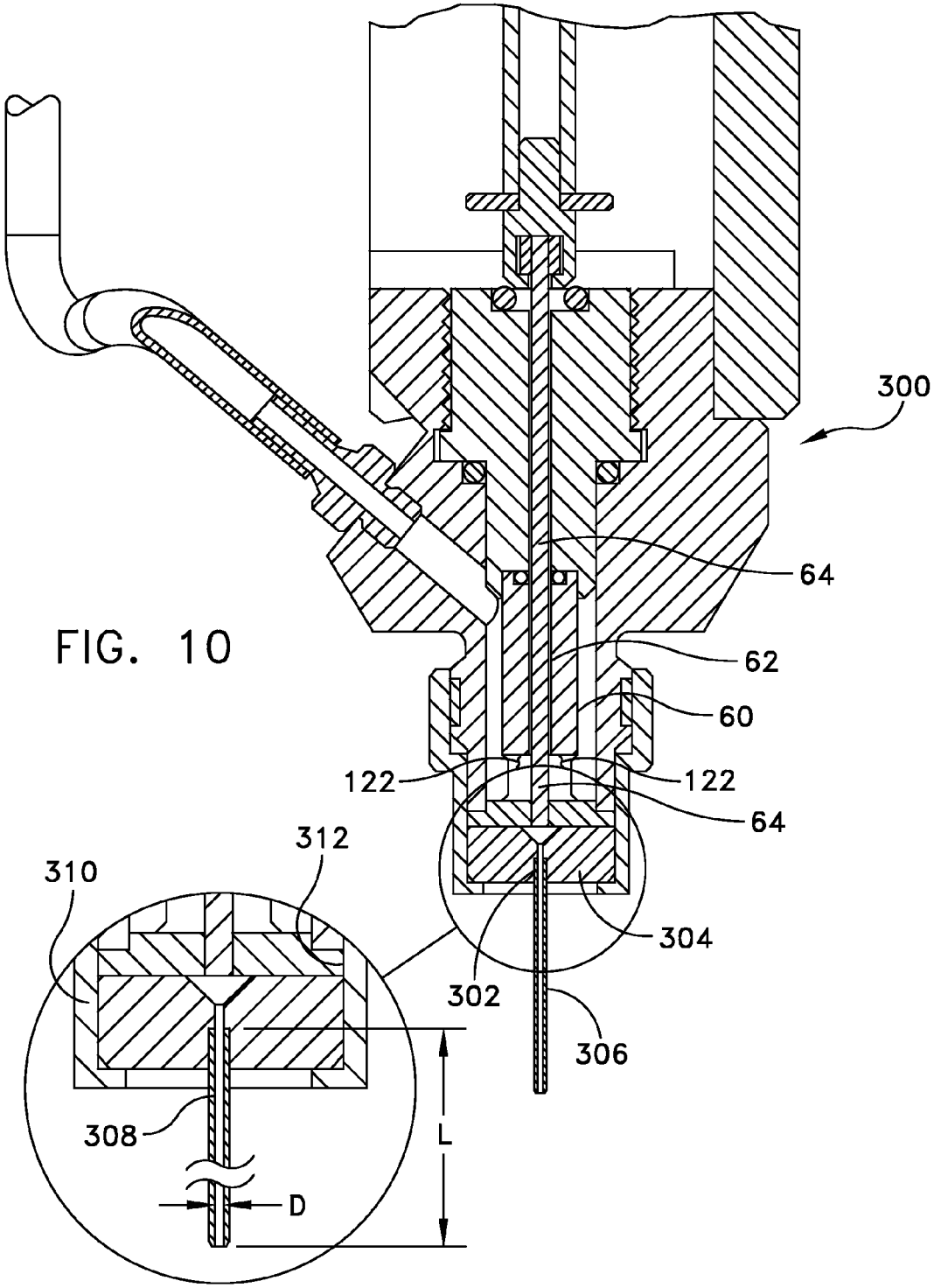
FIG. 10 is an enlarged cross-sectional view of a dispenser unit of another embodiment of the disclosure.

Turning now to FIG. 10, a dispenser unit, generally indicated at 300, of another embodiment is shown. The dispenser unit 300 is substantially identical to dispenser unit 14. Thus, corresponding parts are designated with corresponding reference numbers in FIG. 10. The nozzle assembly 34 includes a nozzle 302 having a head portion 304 and a needle portion 306 extending downwardly from the head portion. The needle portion 306 includes a needle bore 308 having an inner diameter D and a length L substantially greater than the inner diameter. In certain embodiments, the head portion 304 has a diameter of approximately 0.360 inches and a thickness of approximately 0.134 inches. The inner diameter D of the needle bore 308 is approximately between 0.010 to 0.033 inches. The length L of the needle bore 308 is between 0.25 and 0.591 inches. Thus, in certain embodiments, the ratio of the length L to the inner diameter D may range from approximately 7.5:1 to approximately 60:1. In certain embodiments, a dimple or funnel feature may be included on a top surface of the head portion 304 to direct viscous material into the dispensing bore 308 of the nozzle 302.

As shown, the dispensing bore 104, which is in fluid communication with the needle bore 308, is configured to receive the piston 62 therein to dispense material on the substrate. The needle nut 80 is configured to capture the head portion 304 of the nozzle 302 to secure the nozzle to the nozzle housing 56. Specifically, the needle nut 80 has a cup portion 310 configured to receive the head portion 304 of the nozzle 302 therein and an inner threaded surface 312 configured to mate with threads (not designated) provided on the nozzle housing 56.

In operation, the dispenser unit (e.g., dispenser unit 14) is positioned at a nominal clearance height above the substrate, e.g., circuit board 12. This clearance height is maintained at a relatively consistent elevation above the circuit board throughout the dispense operation, although variations in the height of the circuit board, or irregularities in the flatness of the top surface of the circuit board, may cause the clearance height to vary without adversely impacting the dispensing of viscous material. Specifically, the dispenser unit does not need to lift the nozzle away from the circuit board in the z-axis direction at the end of each dispense operation. However, to accommodate variations in the height of the circuit board and irregularities in the flatness of the circuit board (or to even avoid obstacles), the dispenser may be configured to achieve z-axis movement.

In one embodiment of the disclosure, to achieve the object of maintaining the height of the nozzle of the dispenser unit at a desired elevation above the circuit board, there is provided a system for measuring the height of the dispenser nozzle above the circuit board in the z-axis direction. In some height (or distance) measuring systems, physical contact is made between the measuring system and the surface (e.g., a surface of a substrate embodying a printed circuit board) to be measured. One such height measuring system is described in U.S. Pat. No. 6,093,251, entitled APPARATUS FOR MEASURING THE HEIGHT OF A SUBSTRATE IN A DISPENSING SYSTEM, which is assigned to the assignee of the disclosure, and is incorporated herein by reference. Specifically, U.S. Pat. No. 6,093,251 discloses a measuring probe that is extendable between a reference point and a location on the circuit board to measure the height of the substrate.

In other height measuring systems, a laser light source and an optical sensing system are combined to measure the position of an object without making physical contact. An example of a non-contact measuring system is manufactured and distributed by Micro-Epsilon Messtechnik GmbH of Ortenburg, Germany. The optical sensing system can replace the measuring probe. In other embodiments of the disclosure, the height measuring system can be incorporated to facilitate the measurement of and compensation for variations in the vertical position of the top surface of the circuit board.

Using height measuring systems described above, dispensers of the disclosure may be capable of measuring the distance or height of the tip of the nozzle above the top surface of the circuit board. Maintaining the height of the nozzle above the substrate is one factor to control in an effort to optimize the operation of the dispenser. Specifically, the height of the nozzle above the circuit board should be sufficient to ensure the dispensing of material out of the nozzle without risk of the nozzle touching the circuit board. Also, the height of the nozzle, if too high above the circuit board, may cause the material to splash on the circuit board and cause undesirable satellites.

Once the height of the nozzle above the top surface of the circuit board is determined and corrected, if required, the dispenser unit may be engaged to dispense viscous material. A predetermined dispense operation may be programmed into the controller of the dispenser, which may form a part of a line of equipment used to surface mount components onto a printed circuit board. Specifically, an area of the top surface of the circuit board requiring viscous material is preprogrammed into the controller. The rate at which material is dispensed by the dispenser is controlled by manipulating the operation of the motor and the speed at which the nozzle is moved over the circuit board. The speed at which the motor operates and the viscosity of the material being dispensed are factors used to determine an optimal desired volumetric flow rate, i.e., the rate at which the motor operates. Given the dispensing of material and the lack of z-axis directional movement of the nozzle over the circuit board, the material is capable of being dispensed quickly and efficiently to cover the predetermined area.

During dispensing, the dispensing of material is initiated, and lateral motion (i.e., x-axis and y-axis) of the dispenser is commenced. The flow rate of material should be sufficient to overcome the surface tension of the material within the nozzle. Once the area is covered with the desired amount of material, the dispensing operation is terminated. The dispenser ejects material from the nozzle with sufficient inertia so that when the dispenser ceases the flow of material, the material breaks free from the nozzle. As described above, by varying the volumetric flow rate at which the material is dispensed by manipulating the speed of operation of the motor of the dispenser, the velocity of the material as it exits the needle and thus the velocity at which it impacts the circuit board can be controlled by the controller. If too low a volumetric flow rate is used, the exit velocity, and therefore the exit inertia, is insufficient to enable the material to clearly detach from the nozzle. If too high a volumetric flow rate is used, then the material impacts the circuit board at too high a velocity which may cause undesirable splashing of material and satellites. Furthermore, by varying the speed at which the dispensing material is moved over the circuit board in the x-axis and the y-axis directions, the effective diameter of the dot of material is additionally controlled.

The stage of measuring the amount of viscous material dispensed can be achieved by monitoring the volumetric flow rate of material dispensed during a dispensing operation. In accordance with one embodiment of the disclosure, the measurement is achieved by measuring the size of the deposited material. Specifically, the height and diameter of material dispensed onto the circuit board is measured by use of an off-axis imaging system. Such a system is disclosed in U.S. patent application Ser. No. 10/831,468, entitled IMAGING AND INSPECTION SYSTEM FOR A DISPENSER AND METHOD FOR SAME, which is assigned to the assignee of the disclosure and incorporated herein by reference. The vision system may be positionable to obtain images of the top surface of the circuit board along an optical axis to capture the image. Specifically, the system determines the characteristics of the dispensed material (e.g., the dispensed material's height and diameter). The characteristics of the dispensed material are compared with acceptable limits programmed into the controller and a determination is made as to whether the circuit board passes inspection or must be re-worked. The information derived from such an imaging system is then used to adjust certain parameters of the dispensing process to more accurately achieve a desired result.

Once measured, the measured amount can be compared to a calculated amount of material dispensed to determine the accuracy of the dispensing operation. Specifically, the volumetric flow rate of the material being dispensed through the dispensing nozzle can be calculated to establish a calculated amount. A flow meter may also be employed to calculate the amount of material being dispensed through the nozzle. The stage of capturing an image to establish a measured amount, although not required, helps improve the accuracy of the dispensing operation since any differential between the measured amount and the calculated amount can be corrected by the controller.

Figure 11:
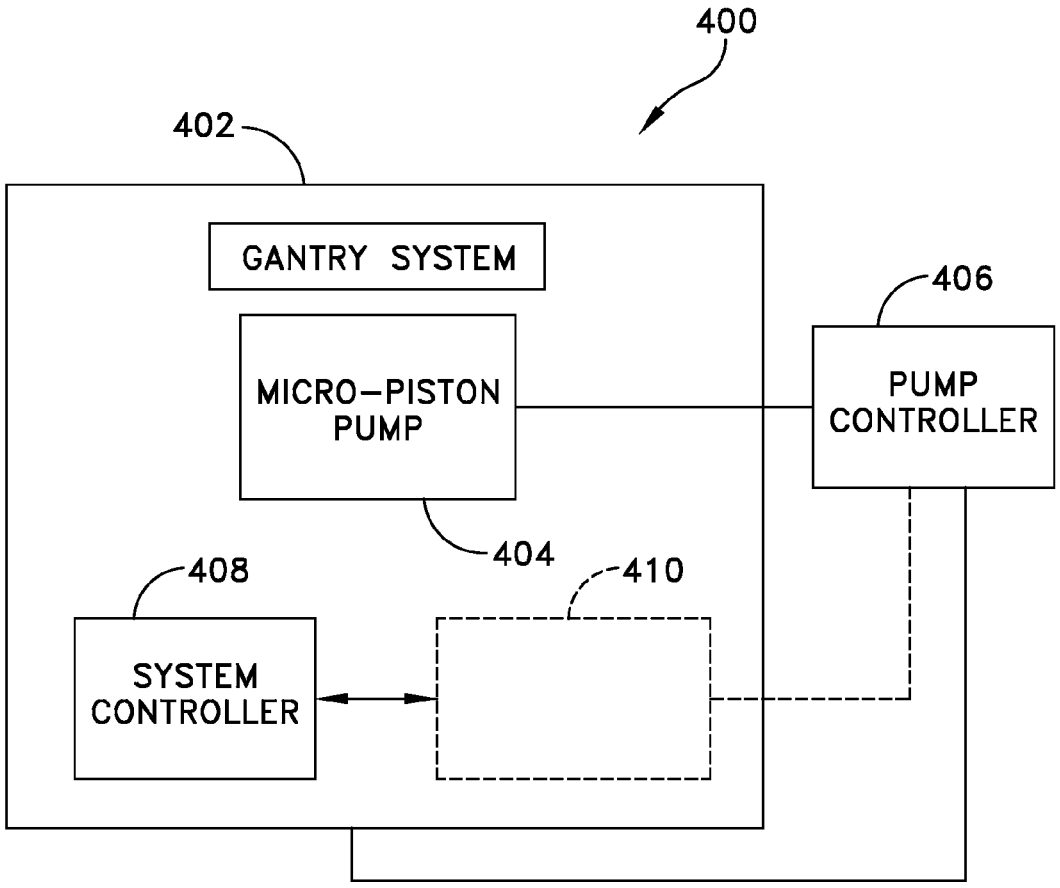
FIG. 11 is a functional block diagram of a dispenser of embodiments of the disclosure.

Referring to FIG. 11, in a certain embodiment, the dispenser may be based on an existing platform, such as a platform dispensing system that is offered under the brand name XyflexPro+, and operates using dispensing software, such as software that is offered under the brand name Benchmark, both of which are offered by Speedline Technologies, Inc. of Franklin, Mass., the assignee of the disclosure.

As indicated in FIG. 11, the primary components of the system, generally indicated at 400, may include the dispensing platform 402, the micro-piston pump or dispenser unit 404, a pump controller 406, and a system controller 408. The dispenser system 400 may provide an interface designated by dashed lines at 410 that allows the dispensing platform 402 to operate with a number of different pumps and/or valves using a standard interface. The digital interface 410 provides signals to trigger dispensing from the micro-piston pump 404.

In one embodiment, the interface 410 may be a standard real-time digital interface. In another embodiment, the dispenser system 400 may also include a generic interface option. The generic interface provides a standard interface that includes the real time digital interface, as well as an optional standard RS-232 interface. The system controller 408, through a 3rd party API and database object, provides standard commands to provide set-up parameters for different valves and pumps and receives status monitoring information from the valves and pumps. In other versions, an Ethernet connection may be provided between the system controller 408 and the pump controller 406.

The pump controller 406 may be selected from a commercially available motion and I/O controller selected from any number of commercially available controllers, for example, a controller offered by Galil (DMC-4010) of Rocklin, Calif. The pump controller 406 may be packaged with a PWM amplifier and power supply and may be housed within a metal enclosure. Alternatively, a DMC-4020 controller may operate two micro-piston pump units. A power switch (not shown) may permit the pump controller 406 to be turned on and off independent from the dispensing platform 402.

As discussed above, dispensing platform 402 may include a conveyor system, an x-y gantry system, a weigh scale calibration system and a nozzle cleaning station. The conveyor system may be used to shuttle substrates, such as circuit boards, to a dispensing position in the system. The x-y gantry system may include a mounting plate to which the micro-piston pump 404 is coupled. The x-y gantry system may be used to position the micro-piston pump 404 to dispensing positions over a substrate. The x-y gantry system also may include the capability to raise and lower (z-axis movement) the pump 404 to vary or control the dispensing height above the substrate.

The operation of the micro-piston pump unit 404 may be controlled through a user interface coupled to the system controller 408. A user, through the interface, controls parameters of the micro-piston pump unit 404 including the retracted height of the piston and the dwell time of the piston. Using different parameter settings, the pump 404 can be operated in a number of different modes to dispense materials over a wide range of viscosity and volume of material dispensed.

In the dispenser, pressurized air may be applied to the source of material of the pump by the dispensing platform 402. The pressurized air may be used to force material from the material source into the pump 404. The particular pressure provided may be selected and manually adjusted based on the material being used, volume of material being dispensed, and mode of operation of the valve. In typical applications, the pressure applied to the material is expected to be on the order of 4-20 psi.

As discussed above, an optional nozzle heater may be used with the micro-piston pump 404, and a temperature of the nozzle heater may be set by the user. The nozzle heater may be configured to surround the lower portion of the pump. In one configuration, the nozzle heater may include a cartridge heater and a temperature sensor. The nozzle heater may be controlled by the system to maintain the temperature sensor at a set temperature.

In one embodiment, the nozzle heater may be constructed to be attached to the lower portion of the dispenser unit to provide heat to the nozzle of the unit. The nozzle heater may include a connecting cable, a body, a connector mounting block, a connector, mounting hardware, a cartridge heater, and a temperature sensor. The body may be configured to have a conical lower opening through which the nozzle extends. Clamps may be provided to secure the nozzle heater to the pump by compressing the housing against the nozzle nut. Pins may be used to align the heater to the pump. The cartridge heater and the temperature sensor may be coupled to the system controller 408, which maintains the temperature in the vicinity of the temperature sensor to a set value.

During operation of the dispenser, a user, through a user interface for the dispensing platform 402, defines dispensing areas on a circuit board. In some embodiments of the dispenser, the pump 404 may be used only to dispense lines of material formed through multiple dispensing cycles of the pump; however, in other embodiments, material may be dispensed at selected locations on a circuit board or other substrate using an individual dispensing cycle or multiple dispensing cycles. For lines of material, a user defines the start and stop positions of a line, and the dispensing platform is able to move the pump to place material along the line.

Once all dispensing areas on a circuit board are defined and the dispensing parameters are set, the dispenser is able to receive circuit boards for processing. After moving a circuit board to a dispensing location, the dispenser controls the gantry system to position the micro-piston pump 404 over a dispensing location. The dispensing location may be a particular point or the start of a line. The system controller 408 of the dispenser system 400 then sends a "start" control signal over the real-time control line instructing the micro-piston pump to start dispensing. If a line of material is to be dispensed, the dispenser system 400 will start moving after issuing the "start" control signal. Once the pump 404 receives the "start" signal, the pump starts dispensing using the parameters (including cycle rate) previously set. The pump 404 continues dispensing until a "stop" or command is received from the system controller 408. The cycle rate and time duration between the "start" signal and the "stop" signal will determine how many times the pump 404 dispenses material along a given line or at a particular location.

Dispensing for a particular board will continue until material has been dispensed at all locations on the board. The board is then unloaded from the system and a new board can be loaded into the system.

Figure 11A:
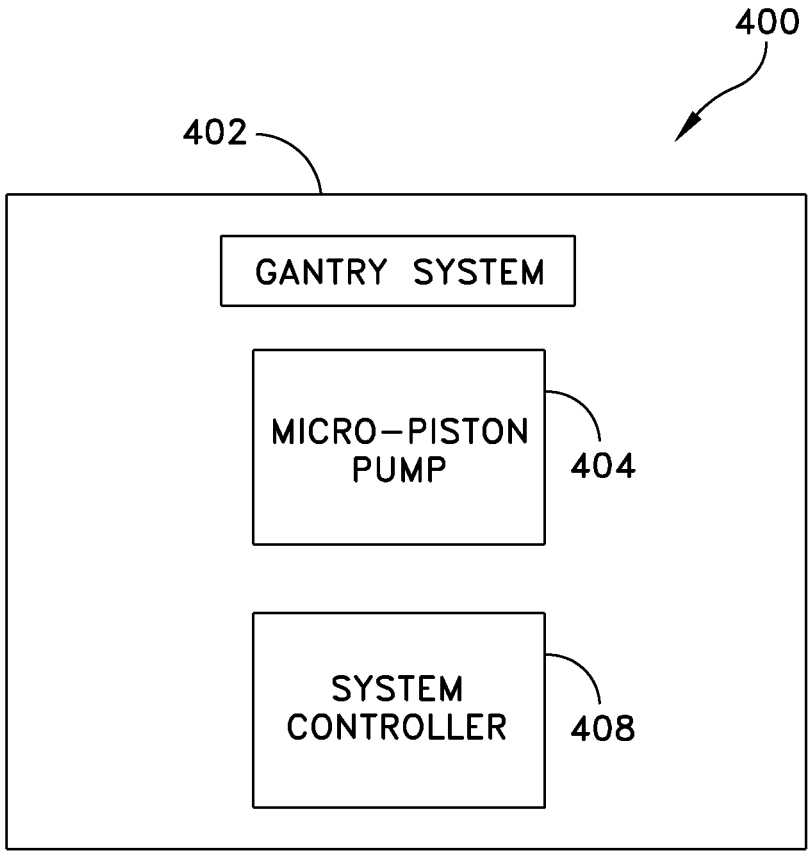
FIG. 11A is a functional block diagram of a dispenser of another embodiment of the disclosure.

In another embodiment, and with reference to FIG. 11A, the primary components of the system 400 may include the dispensing platform 402, the pump 404 and gantry system (not designated) and the system controller 408. As will be discussed below, the magnetic drive of one embodiment of the disclosure eliminates the need for a dedicated pump controller.

Figure 12:
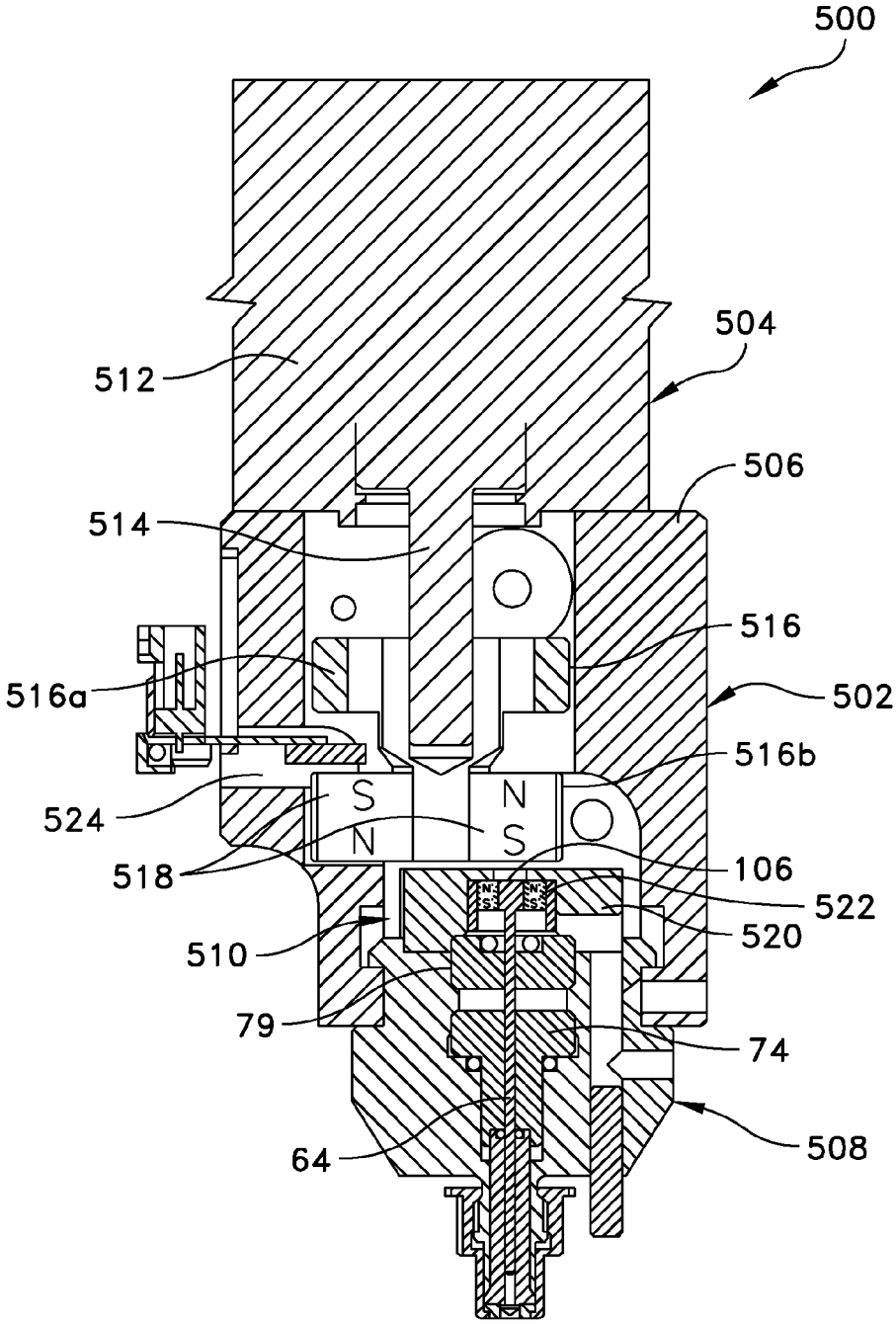
FIG. 12 is a cross-sectional view of a dispenser unit of another embodiment of the disclosure.
Figure 13B:
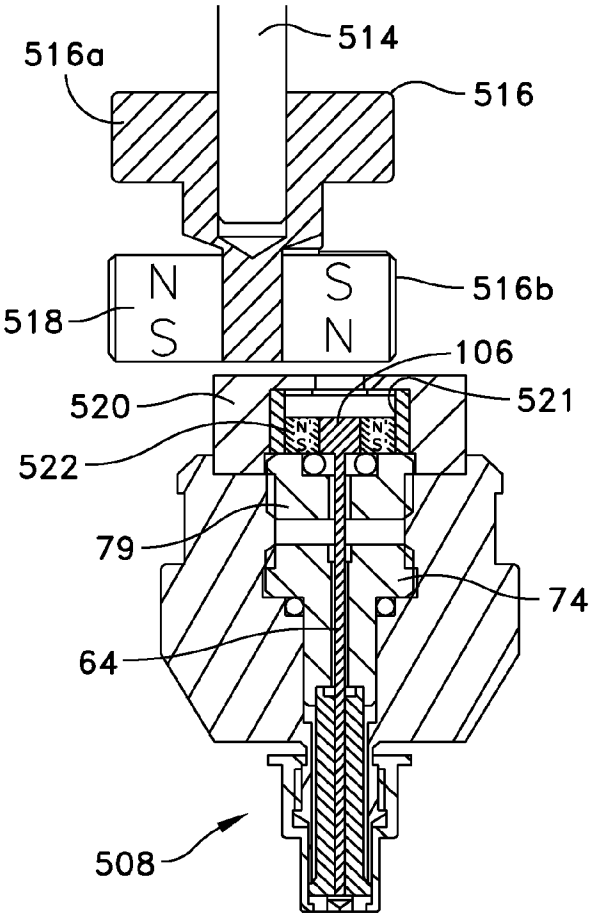
FIG. 13B is an enlarged cross-sectional view of a portion of the dispenser unit shown in FIG. 12 with the dispenser unit shown in a dispense position.
Figure 13A:
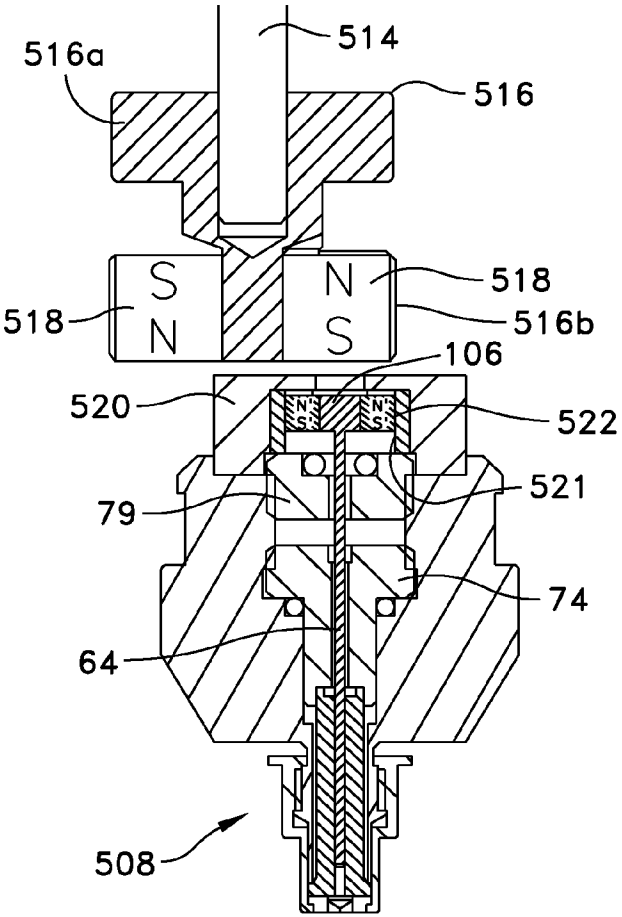
FIG. 13A is an enlarged cross-sectional view of a portion of the dispenser unit shown in FIG. 12 with the dispenser unit shown in a pre-dispense position.
Figure 14:
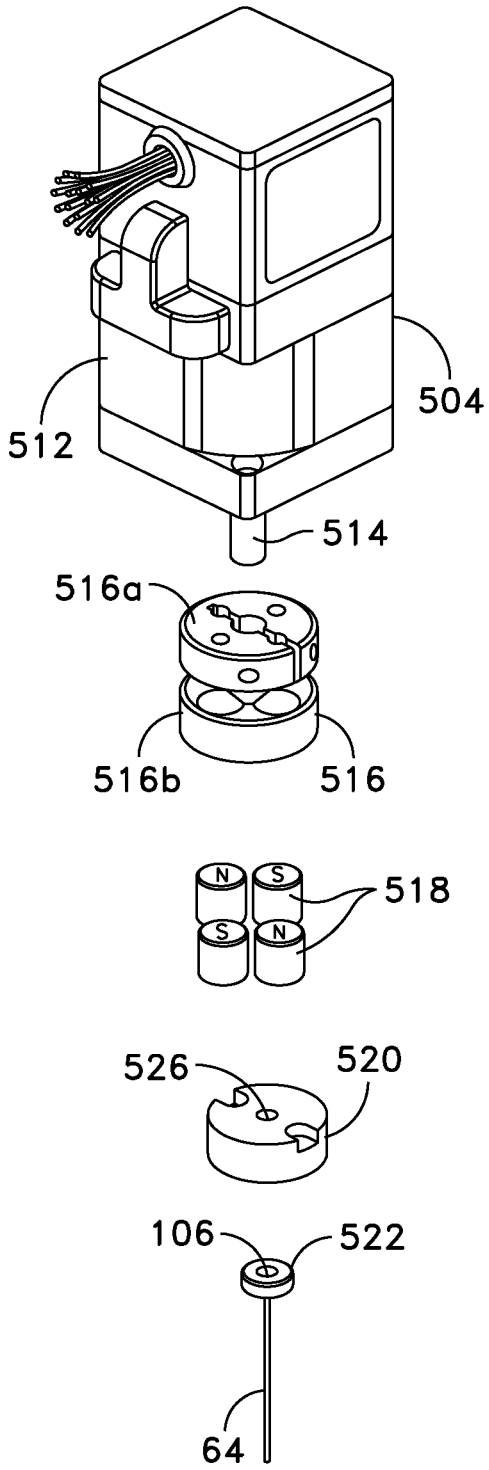
FIG. 14 is an exploded perspective view of the dispenser unit shown in FIGS. 12 and 13.

Turning now to FIGS. 12-14, there is generally indicated at 500 a dispenser unit that is substantially identical to dispenser units 14, 200 and 300. The dispenser unit 500 includes a dispensing assembly generally indicated at 502 having a motor assembly generally indicated at 504, a dispenser housing 506 and a nozzle housing generally indicated at 508. Although not shown, the dispenser unit 500 may also include an encoder assembly that is similar to encoder assembly 28.

In the embodiment shown in FIGS. 12-14, the motor assembly 504 embodies a magnetic drive generally indicated at 510 that serves as a mechanism for converting rotational motion into reciprocating linear motion. The magnetic drive 510 is used to rapidly drive a small fluid displacement piston for dispensing small volumes of material in a non-contact dispenser. With the voice coil motor 30 described above, the smallest amount of material that is capable of being dispensed is approximately 0.25 mg. With the magnetic drive 510 described with reference to FIGS. 12-14, the dispensing assembly 502 is enabled to dispense smaller amounts of material, e.g., 0.10 mg of material.

The motor assembly 504, including magnetic drive 510, may be configured to communicate with the controller 16. As shown, the dispenser housing 506 may be configured to contain the components of the magnetic drive 510. The motor assembly 504 may include a drive motor 512 mounted on the dispenser housing 506, the drive motor having a rotating drive shaft 514 that extends within the dispenser housing. The arrangement is such that the drive motor 512 drives the rotation of the drive shaft 514 at a desired speed.

Attached to the drive shaft 514 is a magnet wheel 516 having four drive magnets, each indicated at 518, spaced circumferentially around the wheel (see FIG. 14). In one embodiment, an upper body 516*a* of the magnet wheel 516 is configured to be clamped onto the drive shaft 514 of the drive motor 512. As best shown in FIG. 14, in one embodiment, the four drive magnets 518 are equally spaced around the circumference of a lower body 516*b* of the magnet wheel 516. Each drive magnet 518 includes opposite poles, which are indicated as N and S in the drawing figures. As shown, the drive magnets are arranged such that the polarity of each magnet is opposite its adjacent magnet. In other embodiments, the drive magnets 518 may be spaced from one another predetermined distances so that the drive magnets are not equally spaced around the circumference of the lower body 516*b* of the magnet wheel 516. For example, as the magnet wheel 516 rotates at a constant speed, it may be desirable to effect the time between the upstroke and the down stroke so that it is different than the time between the down stroke and the upstroke. To achieve this time difference, the spacing of the drive magnets 518 may be spaced apart from one another so that they are not equally spaced around the circumference of the lower body 516*b* of the magnet wheel 516.

Although four drive magnets 518 are provided in the shown embodiment, it should be understood that any number of drive magnets may be provided and fall within the scope of the instant disclosure. For example, two drive magnets 518 may be disposed on the magnet wheel 516 with the drive magnets being oppositely disposed from one another. With another example, six or eight drive magnets may be equally spaced round the periphery of the magnet wheel to increase the reciprocating motion of the piston 64.

The motor assembly 504 further includes a magnet guide 520 that is secured within the dispenser housing 506 and a driven magnet 522 that is disposed within a bore 521 of the magnet guide. As shown, the magnet guide 520 is annular in construction and disposed above the nozzle housing 508. The driven magnet includes opposite poles, which are indicated as N' and S' in FIGS. 12, 13A and 13B. In the shown embodiment, the driven magnet 522 has the N' pole disposed adjacent the drive magnets 518 and the S' pole disposed on the opposite (lower) side. As best shown in FIG. 14, the driven magnet 522 is attached (e.g., by an appropriate bonding process) to the head 106 of the piston 64 and configured to move vertically within the bore 521 provided in the magnet guide 520. The arrangement is such that the rotation of the motor 512 alternately disposes poles (N and S) of the drive magnets 518 against the N' pole of the driven magnet 522. The resultant attraction and repulsion forces cause the driven piston 64 to rise and fall in the chamber causing the filling and expulsion of dispensed fluid in the manner described above. As with dispenser unit 14, compliant material 79 may be disposed above the seal nut 74 to provide a resilient force to cause the rapid deceleration of the driven magnet 522 and the piston 64 as they complete their downward stroke.

As the relative distance between the drive magnets 518 and the driven magnet 522 increases, the resultant force between the magnets decreases. In one embodiment, using high strength rare earth magnets where the field is saturated magnetically could be used to extend the distance where the driven magnet would be under maximum repulsive force. As the magnets are confined to an area where the field is effectively saturated, the force applied to each driven magnet is effectively constant over a useful distance.

With the drive magnets 518, the magnetic S poles may also be used to activate a Hall effect home switch 524, which may be used to locate the correct poles and orientation of the magnet wheel 516 during the system start-up. Thus, predictable magnetic interactions may be achieved.

FIG. 13A illustrates the dispenser unit 500 shown with magnetic poles of one of the drive magnets 518 (the S pole) and the driven magnet 522 (the N' pole) attracting to one another thereby causing the piston 64 to rise so that fluid fills the chamber. In this position, the driven magnet 522 and the head 106 of the piston 64 are disposed in an upper portion of the bore 521 of the magnet guide 520. FIG. 13B illustrates the dispenser unit 500 shown with magnetic poles of another one of the drive magnets 518 (the N pole) and the driven magnet 522 (the N' pole) repelling one another thereby causing the piston 64 to lower so that fluid expels from the chamber. In this position, the driven magnet 522 the head 106 of the piston 64 are disposed in a lower portion of the bore 521 of the magnet guide 520. In the embodiment shown in FIGS. 13A and 13B, the respective motions are caused by a one quarter turn of the drive motor 512.

As mentioned above, the number and orientation of the drive magnets and the driven magnet (or magnets) may be different than the embodiment disclosed in the drawing figures. In another embodiment, the driven magnet may include a yoke, which in turn would drive the reciprocating motion of the piston. Although the provision of a yoke may have a higher moving mass, a benefit may be observed from not having to bond the driven magnet directly to the piston head.

As shown in FIG. 14, the magnet guide 520 may be formed with vent holes, with the vent hole 526 being shown in a top of the magnet guide. A similar vent hole may be formed in a bottom of the magnet guide 520. The vent holes allow air to escape from and return to the bore 521 formed within the magnet guide 520.

In certain embodiments, the magnet guide 520 may be fabricated from any suitable material capable of withstanding the back and forth motion of the driven magnet 522 and head 106 of the piston 64 within the bore 521 of the magnet guide.

In contrast with the various positions achieved by using a voice coil motor 30 with reference to FIG. 9E, the magnetic motor assembly 504 of embodiments of the disclosure moves the piston in two distinct positions—an up position and a down position. Accordingly, the operation of the dispenser is simplified by the provision of the magnetic motor assembly.

Thus, it should be observed that dispensers of at least one embodiment of the disclosure are capable of accurately dispensing viscous material. The dispenser of embodiments of the disclosure is capable of having the nozzle assembly quickly and easily replaced to vary the size of material dispensed on the substrate. Also, given the configuration of the piston and the dispensing bore, the preciseness of the volume of material deposited on the substrate is further enhanced.

The dispenser unit disclosed herein may be employed on any suitable dispenser. For example, a dispenser unit having a different material supply configuration or movement configuration may be employed. In addition, various additional components may be added to the dispenser. For example, the dispenser may include a needle cleaner, such as the needle cleaner disclosed in U.S. Pat. No. 6,775,879, entitled NEEDLE CLEANING SYSTEM, which is owned by Speedline Technologies, Inc., the assignee of the disclosure. Additionally, the dispenser may include a weigh scale, such as the weigh scale disclosed in U.S. Pat. No. 6,814,810, entitled APPARATUS FOR CALIBRATING A DISPENSING SYSTEM, which is also owned by Speedline Technologies, Inc.

Other advantages may include enabling a more rapid reciprocating motion of the piston, with faster acceleration of the piston. The use of the magnetic motor provides this rapid reciprocating motion while generating less heat than the voice coil motor configuration. A significant advantage is the dispenser unit's ability to deposit small amounts of material (e.g., 0.10 mg) onto the substrate.

Having thus described at least one embodiment of the disclosure, various alternations, modifications and improvements will readily occur to those skilled in the art. Such alterations, modifications and improvements are intended to be within the scope and spirit of the disclosure. Accordingly, the foregoing description is by way of example only and is not intended to be limiting. The disclosure's limit is defined only in the following claims and equivalents thereto.

What is claimed is:

1. A method of dispensing viscous material on an electronic substrate by driving reciprocating movement of a piston within a dispensing bore of a dispenser unit configured to dispense the viscous material, the method comprising:

providing a motor to drive the movement of the piston within the dispensing bore, the motor including a rotating shaft, a wheel coupled to the rotating shaft, the wheel having a plurality of drive magnets disposed circumferentially around the wheel, and a driven magnet coupled to the piston to drive the axial movement of the piston, wherein the motor further includes a magnet guide having a bore configured to receive the driven magnet;

rotating the plurality of drive magnets with the motor to cause the movement of the piston; and ejecting a quantity of viscous material when moving the piston.

2. The method of claim 1, wherein the dispensing unit includes a housing having the dispensing bore.

3. The method of claim 2, wherein the piston has an elongate body disposed within the dispensing bore, the piston being configured to move between a pre-dispense position and a dispense position within the chamber.

4. The method of claim 3, wherein the dispensing unit further includes a nozzle coupled to the housing, the nozzle having an orifice to dispense viscous material.

5. The method of claim 1, further comprising controlling the operation of the motor with a controller.

6. The method of claim 1, wherein the plurality of drive magnets are equally spaced from one another.

7. The method of claim 1, wherein the piston further has a head located at a top of the piston, the head being attached to the driven magnet.

* * * * *